US011433973B2

(12) United States Patent
Losev et al.

(10) Patent No.: US 11,433,973 B2
(45) Date of Patent: Sep. 6, 2022

(54) INFLATABLE MOTOR BOAT

(71) Applicant: Solar Ltd., Novosibirsk (RU)

(72) Inventors: Mihail Viktorovich Losev, Novosibirsk (RU); Sergey Valer'evich Chesnokov, Novosibirsk (RU); Vyacheslav Ivanovich Pineker, Novosibirsk (RU)

(73) Assignee: SOLAR LTD., Novosibirsk (RU)

( * ) Notice: Subject to any disclaimer, the term of this patent is extended or adjusted under 35 U.S.C. 154(b) by 0 days.

(21) Appl. No.: 16/757,876

(22) PCT Filed: Nov. 7, 2019

(86) PCT No.: PCT/RU2019/000793
§ 371 (c)(1),
(2) Date: Apr. 21, 2020

(87) PCT Pub. No.: WO2020/167159
PCT Pub. Date: Aug. 20, 2020

(65) Prior Publication Data

US 2021/0024175 A1 Jan. 28, 2021

(30) Foreign Application Priority Data

Feb. 15, 2019 (RU) ..... RU2019104345
Mar. 29, 2019 (RU) ..... RU2019109225
Oct. 31, 2019 (RU) ..... RU2019134979

(51) Int. Cl.
*B63B 7/08* (2020.01)
*B63B 1/04* (2006.01)
*B63C 9/04* (2006.01)

(52) U.S. Cl.
CPC ..... *B63B 7/082* (2013.01); *B63B 1/042* (2013.01); *B63B 7/085* (2013.01); *B63C 2009/042* (2013.01)

(58) Field of Classification Search
CPC ..... B63B 7/08; B63B 7/082; B63B 7/085; B63B 7/087; B63B 1/042; B63B 2001/201; B63B 2001/202; B63C 2009/042
See application file for complete search history.

(56) References Cited

U.S. PATENT DOCUMENTS 23,105 A * 3/1859 Montgomery ..... B63H 5/16 440/69
4,603,651 A 8/1986 Harding
(Continued)

FOREIGN PATENT DOCUMENTS

RU 145840 U1 9/2014
RU 154960 U1 9/2015
(Continued)

*Primary Examiner* — Ajay Vasudeva
(74) *Attorney, Agent, or Firm* — Muncy, Geissler, Olds & Lowe, P.C.

(57) ABSTRACT

An inflatable motor boat with a U-shaped hull in plan view and configured to operate in shallow water. An inflatable bottom is attached to the hull and comprises an inclined longitudinal tunnel having an arc-shaped form in cross section. A portion of the tunnel is wedge-shaped with an angle of inclination from 5° to 45°. The width of the tunnel can be reduced in a rearward direction, and an upper surface of the tunnel can have a sinusoidal shape in a longitudinal section.

17 Claims, 10 Drawing Sheets

(56) References Cited

U.S. PATENT DOCUMENTS

| | | | | | |
|---|---|---|---|---|---|
| 4,609,360 | A * | 9/1986 | Whitehead | B63H 5/16 | 114/288 |
| 4,915,668 | A * | 4/1990 | Hardy | B63H 5/16 | 114/288 |
| 6,981,460 | B1 * | 1/2006 | Wheeler | B63B 1/38 | 114/67 A |
| 7,424,859 | B1 * | 9/2008 | Clancey | B63B 1/042 | 114/289 |
| 10,710,679 | B2 * | 7/2020 | Zykov | B63B 7/08 | |

FOREIGN PATENT DOCUMENTS

| | | | |
|---|---|---|---|
| RU | 173888 | U1 | 9/2017 |
| RU | 177429 | U1 | 2/2018 |

* cited by examiner

H - H

I - I

INFLATABLE MOTOR BOAT

FIELD OF THE INVENTION

The present invention relates to water vehicles, in particular, to inflatable boats with outboard engines operating in low water conditions.

BACKGROUND OF THE INVENTION

It is known a technical solution disclosed in the patent for invention RU 2389633 C2 (IPC B63B 7/08; published 20 May 2010) "Motor inflatable boat (versions)", which is an inflatable motor boat comprising a U-shaped hull in plan view formed by open outline of inflatable boards and bow part, a transom installed in the stern part of the boat, and an inflatable bottom attached to the hull from below with the end deadrise angle from 0° to 50°, wherein the stern face itself is made flat.

The above-described inflatable motor boat has, in the opinion of the author, the necessary and sufficient water resistance at the water flow separation point of the inflatable bottom stern face at the moment of coming onto plane (into gliding) and in the boat planing mode, which in turn allows high moving speed with no loss of stability.

However, this boat design also provides no solution of the problem of the outboard engine use in low water conditions and when beaching, because the propeller of the outboard engine motor with such bottom configuration of the boat should also be located below the bottom. In addition, this configuration of the outboard engine of the boat could result in possible propeller damage being caused by different stock in the water when boating.

It is known a technical solution disclosed in the utility model patent RU 145840 U1 (IPC B63B 7/00; published 27 Sep. 2014) "Inflatable motor boat", which is an inflatable motor boat comprising a U-shaped hull in plan view formed by open outline of inflatable boards and bow part, a transom installed in the stern part of the boat, and an inflatable bottom attached to the hull from below, wherein a longitudinal tunnel having a wedge-shaped form in a vertical section is made on the side contacting the water, starting from the stern face, wherein the tunnel depth is reduced uniformly toward the bow part of the boat, the length of the tunnel is from 5 to 50% of the overall length of the boat, and its depth at the bottom stern face is from 2 to 10 cm.

The known motor boat partially provides the solution of the problem of moving in low water conditions and beaching, however, the volume of the stern part of the bottom is reduced due to the presence of the tunnel, which results in a deeper draft under the weight of the engine, especially at low speeds or without motion. Accordingly, the engine itself in these cases is also located deeper in the water, and the risk of damage thereof increases.

As a prototype, a known technical solution disclosed in the utility model patent RU 177429 U1 (IPC B63B 7/082; published 21 Feb. 2018) "Inflatable motor boat" is taken, which is an inflatable motor boat comprising a U-shaped hull in plan view formed by open outline of inflatable boards and bow part, an inflatable bottom attached to the hull, and a transom installed in the stern part of the boat. A longitudinal tunnel is made on the lower side of the inflatable bottom of the boat, which tunnel comprises two side walls and one upper surface conjugated with the side walls. At the same time, the upper surface of the tunnel consists of two portions blending smoothly one into the other. The first portion is located on the stern side and is horizontal, in parallel with the upper surface of the inflatable bottom. This portion smoothly blends into an inclined portion located closer to the bow part of the boat.

The presence of the tunnel comprising inclined and horizontal portions allows the known boat to direct the water flow at a certain angle upward when in motion, which provides water supply to the propeller of the outboard engine.

However, this configuration of the boat has a significant drawback associated with the risk of air entering the tunnel, and, as a result, an increase in the likelihood of the water flow disruption when the boat is moving, that is, the motion will be non-uniform. In addition, the known boat does not structurally allow the mounting of transom plates, which, in turn, is also a serious drawback. This results in an increase in the amount of time required for coming onto plane (into gliding), and also is responsible for a deeper draft of the known utility model. This, in turn, increases the risk of damage to the propeller of the outboard engine.

Terms and Definitions

In the text of this patent application, the terms below are used in the following meanings.

U-shaped is similar to the inverted letter U.

An anti-cavitation plate is a plate located above the propeller of the outboard engine and designed to prevent the propeller from capturing air from the surface, thereby preventing the occurrence of cavitation.

Gliding is the moving of a water vehicle along the surface of the water, in which the water vehicle is held on the surface of the water due to the water dynamic pressure and the buoyant power created thereby.

The boat length is the overall length from the bow to the straight line connecting the extreme points of the inflatable boards.

Cavitation is the formation of cavities in water (cavitation bubbles or caverns), which are filled with gas, steam or a mixture thereof. Cavitation occurs as a result of a local decrease in the water pressure, which occurs with increasing water velocity. Moving with the flow to a location with a higher pressure, the cavitation bubble slams, emitting a shock wave.

A wedge-shaped portion is a portion comprising at least one upper inclined surface and at least 2 side surfaces (side walls) conjugated with the upper inclined surface. Thus, said portion has a shape in a longitudinal section close to the shape of a wedge. Additionally, the upper inclined surface and the side surfaces (side walls) can be made curved, for example, convex.

The bottom stern face is the vertical or inclined surface of the inflatable bottom, located on the stern part of the inflatable motor boat.

The lower surface of the inflatable bottom is the surface located at the underside of the inflatable bottom and contacting with the water surface plane when the inflatable motor boat is moving.

The engine leg is an element of the outboard engine of the boat, inside which the engine is connected to the propeller; the length of the leg is the distance from the upper engine attachment point on the transom to the anti-cavitation plate located directly above the propeller of the outboard engine.

Essentially arc-shaped form is a shape of the object that is close to or similar to an arc. In particular, the inner surface of the tunnel has an essentially arc-shaped form, which is stipulated by, on the one hand, the fact that the angle of inclination of the tangent to the side wall of the tunnel relative to the water surface plane can be no more than 45° from the vertical line. In the inflated state, therefore, the shape of the side walls and the upper inclined surface of the tunnel becomes rounded. On the other hand, in view of the structural features of the boat, namely the fact that the elements of the inflatable bottom are connected to each other by means of butt seams, the joint places between the side walls and the upper inclined surface of the tunnel are presented by small natural recesses. Thus, the shape of the inner surface of the tunnel is well-rounded and close to the arc in a cross section due to the roundness of the side walls of the tunnel and the upper inclined surface of the tunnel, and, at the same time, the inner surface of the tunnel is characterized by natural recesses due to the connection of the bottom elements using seams.

Π-shaped is similar to the letter Π.

The sinusoidal shape is a shape of the object, which is close to a sinusoid with constant or variable amplitude.

A transom, in the case of inflatable boats, is a board installed vertically transversely and fixed in the stern part of the boat for subsequent mounting an outboard engine thereon.

A transom plate is a rigid plate of variable thickness, of any possible shape, which is mechanically attached to the lower side of the inflatable bottom in the stern part thereof.

Trapezoidal is shaped like a trapezoid.

The terms used herein are not intended to limit the embodiments of the invention, but merely serve the purpose of describing a particular embodiment. The use of the singular form also implies the implementation of the plural form, if not contrary to the context.

SUMMARY OF THE INVENTION

The problem to which the invention is directed, to improve operational parameters of inflatable motor boats.

The technical result of the claimed invention is the possibility of high-performance boating in low and extreme low depth conditions at different speeds, due to the presence of inclined longitudinal tunnel, with some configuring details in different versions, which allows to improve the water supply to the propellers of the outboard engines or, in the case of water jet engines, to their water jet inlets, optimize their location and eliminate the risk of damage thereof.

The claimed technical result is achieved by the fact that the invention is an inflatable motor boat with a U-shape hull in plan view. The hull of the inflatable motor boat is formed by open outline of inflatable boards and bow part. An inflatable bottom is attached to the hull, which bottom is divided into at least three longitudinal segments. A longitudinal tunnel is made in the middle segment of the bottom, while the inner surface of the tunnel has essentially arc-shaped form. The tunnel comprises a portion having a wedge-shaped form in a vertical section, wherein the angle of inclination of the portion relative to the water surface plane is from 5° to 45°. The tunnel can also comprise an additional portion with an angle of inclination from 0° to 20° relative to the water surface plane, wherein the length of the additional portion is less than the length of the wedge-shaped portion.

Such a configuration of the tunnel provides a gradual change in the angle of inclination of the water flow relative to the water surface plane inside the tunnel when the inflatable motor boat is moving. At first, water enters the inclined longitudinal tunnel having essentially arc-shaped form in a cross section. Then the water flow Changes the angle of inclination at the joint place between the wedge-shaped portion of the tunnel and the additional portion of the tunnel in some versions, Thus, the possibility of the water flow disruption at the inflection points is excluded.

Such a motion of the water flow inside the inclined longitudinal tunnel comprising the wedge-shaped portion and, possibly, the additional portion provides a smooth water motion vector at an upward angle with the supply of water in the required quantity to the propeller of the outboard engine, with no occurrence of turbulence phenomenon at the location of the propeller, due to the fact that the water flow motion vector at the outlet of the inclined tunnel conjugated with the stern face passes through the axis of rotation of the propeller. Due to the fact that the inner surface of the longitudinal tunnel has essentially arc-shaped form, sticking of the water flow takes place inside the tunnel when the boat is moving, which in turn provides the raise of the water flow inside the tunnel, as well as the necessary water flow density for trouble-free operation of the outboard engine. Thus, such a motion of the water flow inside the inclined longitudinal tunnel having essentially arc-shaped inner surface and comprising the wedge-shaped portion and the additional portion, provides a smooth moving of the boat at the time of coming onto plane (into gliding), which ensures high-performance boating, including in low water conditions.

The proposed configuration of one of the possible embodiments of the claimed invention allows the propeller of the outboard engine to be positioned in such a way that the speed vector of the inflatable motor boat coincides with the outboard engine thrust vector and the rotational axis of the propeller, respectively, and is directed to the center of mass of the inflatable motor boat. This results in a smooth moving of the inflatable motor boat and allows to eliminate the effect of the boat oscillating in a vertical plane when in motion, for example, at the time of coming onto plane (into gliding). It follows that such a configuration is optimal for the location of the propeller of the outboard engine, which allows to eliminate the risk of damage to the propeller and improves operational parameters of the boat use in low water conditions.

In the claimed invention, the width of the tunnel at the line of the conjugation with the stern face of the inflatable bottom can be from 20 to 60 cm, Such a width of the tunnel provides a uniform water motion inside the tunnel when the boat is moving. The length of the tunnel can be from 5 to 50% of the overall length of the boat. Such a length of the tunnel, on the one hand, provides the creation of a water flow and supply thereof at the required angle upward, and on the other hand, ensures the course stability of the boat.

At the same time, the angle of inclination of the tangent to the side wall of the tunnel can be no more than 45° from the vertical line. This allows to make the side walls of the tunnel in such a way that the width of the tunnel in a cross section is reduced in the direction from the water surface plane to the upper inclined surface of the tunnel conjugated with its side walls. Such a configuration allows to raise the water flow inside the tunnel when the claimed inflatable boat is moving and provide the necessary water flow density for trouble-free operation of the outboard engine.

As a possible embodiment of the invention, the inflatable bottom can be made flat or can be provided with a keel.

The claimed technical result is also achieved by the fact that the invention is an inflatable motor boat with a U-shaped hull in plan view. The hull of the inflatable motor boat is formed by open outline of inflatable boards and bow part. An inflatable bottom is attached to the hull, which bottom is divided into at least three longitudinal segments. A longitudinal tunnel is made in the middle segment of the bottom, which tunnel comprises a portion having a wedge-shaped form in a vertical section. The stern face of the bottom, conjugated with the tunnel, is made inclined and forms an angle of less than 90° relative to the water surface plane.

Such a design of the tunnel conjugated with the inclined stern face provides a gradual change in the angle of inclination of the water flow relative to the water surface plane inside the tunnel, and then along the inclined stern face when the inflatable motor boat is moving. At first, water enters the inclined longitudinal tunnel comprising the wedge-shaped portion. Then the water flow changes the angle of inclination at the conjugation line between the inclined tunnel and the inclined stern face of the inflatable bottom. Thus, the possibility of the water flow disruption at the inflection points is excluded.

Such a motion of the water flow inside the longitudinally inclined tunnel comprising the wedge-shaped portion, and then along the inclined stern face provides a smooth water motion vector at an upward angle with the supply of water in the required quantity to the propeller of the outboard engine, with no occurrence of turbulence phenomenon at the location of the propeller, due to the fact that the water flow motion vector at the outlet of the inclined tunnel conjugated with the inclined stern face passes through the axis of rotation of the propeller. Also, the water flow motion inside the inclined longitudinal tunnel comprising the wedge-shaped portion, and then along the inclined stern face provides a smooth moving of the boat at the time of coming onto plane (into gliding), which ensures high-performance boating, including in low water conditions.

The proposed configuration of another possible embodiment of the claimed invention allows the propeller of the outboard engine to be positioned in such a way that the speed vector of the inflatable motor boat coincides with the outboard engine thrust vector and the axis of rotation of the propeller, respectively, and is directed to the center of mass of the inflatable motor boat. This results in a smooth moving of the inflatable motor boat and allows to eliminate the effect of the boat oscillating in a vertical plane when in motion, for example, at the time of coining onto plane (into gliding). It follows that this configuration is optimal for the location of the propeller of the outboard engine, which allows to eliminate the risk of the propeller damage and improves the efficiency of the boat use in low water conditions.

In this case, the lower corners of the stern face can be made rounded. In the claimed invention, the tunnel depth at the line of the conjugation with the stern face of the inflatable bottom can be from 2 to 25 cm. Such a width of the tunnel provides a uniform water motion inside the tunnel when the boat is moving. The width of the tunnel at the line of the conjugation with the stern face of the inflatable bottom can be from 20 to 60 cm. Such a length of the tunnel, on the one hand, provides the creation of a water flow and supply thereof at the required angle upward, and on the other hand, ensures the course stability of the boat. At the same time, the angle of inclination of the wedge-shaped portion of the tunnel relative to the water surface plane is from 5° to 45°. Such an angle of inclination of the wedge-shaped portion of the tunnel provides the creation of a water flow and effective supply thereof at the required angle upward, with no occurrence of turbulence phenomenon.

As a possible embodiment of the invention, the inflatable bottom can be made flat or can be provided with a keel.

The claimed technical result is also achieved by the fact that the invention is an inflatable motor boat with a U-shaped hull in plan view. The hull of the inflatable motor boat is formed by open outline of inflatable boards and bow part. An inflatable bottom is attached to the hull, which bottom is divided into at least three longitudinal segments. A longitudinal tunnel is made in the middle segment of the bottom. The stern face of the bottom is made inclined. At least two water channels of variable depth are made in the inflatable bottom as a continuation of the longitudinal tunnel.

Such a design of the inflatable motor boat comprising at least two water channels connected to the inclined tunnel, wherein the tunnel is conjugated with an inclined stern face, provides a gradual change in the angle of inclination of the water flow relative to the water surface plane when passing from the water channels to the tunnel, and then along the inclined stern face when the inflatable motor boat is moving. At first, water enters the water channels, after which it continues to move inside the inclined longitudinal tunnel comprising the wedge-shaped portion. Then the water flow changes the angle of inclination at the conjugation line between the tunnel and the stern face of the inflatable bottom. Thus, the possibility of the water flow disruption at the inflection points is excluded.

Such a motion of the water flow inside the water channels and the inclined longitudinal tunnel comprising the wedge-shaped portion, and then along the inclined stern face provides a smooth water motion vector at an upward angle with the supply of water in the required quantity to the propeller of the outboard engine, with no occurrence of turbulence phenomenon at the location of the propeller. Also, such a motion of the water flow inside the water channels and inclined longitudinal tunnel comprising the wedge-shaped portion, and then along the inclined stern face provides a smooth moving of the boat at the time of coming onto plane (into gliding), which ensures high-performance boating, including in low water conditions.

The proposed configuration of another possible embodiment of the claimed invention also allows positioning the propeller of the outboard engine in such a way that the speed vector of the inflatable motor boat coincides with the outboard engine thrust vector and the axis of rotation of the propeller, respectively, and is directed to the center of mass of the inflatable motor boat. This results in a smooth moving of the inflatable motor boat and allows to eliminate the effect of the boat oscillating in a vertical plane when in motion, for example, at the time of coming onto plane (into gliding). It follows that this configuration is optimal for the location of the propeller of the outboard engine, which allows to eliminate the risk of damage to the propeller and improves the efficiency of the boat use in low water conditions.

The water channels in the context of the claimed invention can be made as a continuation of the joint lines formed between adjacent segments of the inflatable bottom. At the same time, the water channel can have a sinusoidal shape in a longitudinal section. The providing the inflatable bottom with the water channels results in the direction of water flow toward the tunnel when the boat is moving. This effect occurs due to the fact that sticking of the water flow takes place inside the water channel when the boat is moving, with the subsequent water supply into the free volume of the tunnel. At the same time, water entering the tunnel is discharged, since the tunnel with the water channels has a concave shape in the first portion, which makes it easier to move, wherein water is get off from the hull midship, and then the tunnel has a curved arc-shaped form giving water the ability to rise up, much higher than the usual level of the water surface.

The stern face of the bottom, conjugated with the longitudinal tunnel, can be made inclined, with the formation of an angle less than 90° relative to the water surface plane. The longitudinal tunnel, in turn, can comprise the portion having a wedge-shaped form in a vertical section. Both of these design concepts allow the creation of a water flow directed at the necessary upward angle toward the propeller of the outboard engine, with no occurrence of turbulence phenomenon at the location of the propeller of the outboard engine.

In the claimed invention, the depth of the tunnel at the line of the conjugation with the stern face of the inflatable bottom can be from 2 to 25 cm. The width of the tunnel at the line of the conjugation with the stern face of the inflatable bottom can be from 20 to 60 cm. Such a width of the tunnel provides a uniform water motion inside the tunnel when the boat is moving. Such a length of the tunnel, on the one hand, provides the creation of a water flow and supply thereof at the required angle upward, and on the other hand, ensures the course stability of the boat. The angle of inclination of the tunnel relative to the water surface plane can range from 5° to 45. Such an angle of inclination of the wedge-shaped portion of the tunnel provides the creation of a water flow and effective supply thereof at the required angle upward, with no occurrence of turbulence phenomenon. The total length of the tunnel and the water channel connected thereto can be from 20 to 380 cm. These dimensions are resulting from a number of practical experiments under real-life conditions.

The indicated configurations are applicable both to boats with a keeled and flat bottoms.

BRIEF DESCRIPTION OF THE DRAWINGS

The essence of the proposed technical solution is illustrated by drawings.

Features of the invention are disclosed in the following description and in the attached figures illustrating the invention. In the scope of the invention, alternative versions of its implementation can be developed. In addition, well-known elements of the invention will not be described in detail or will be omitted so as not to overload the description of the present invention in detail.

DETAILED DESCRIPTION OF THE INVENTION

Figure 2:
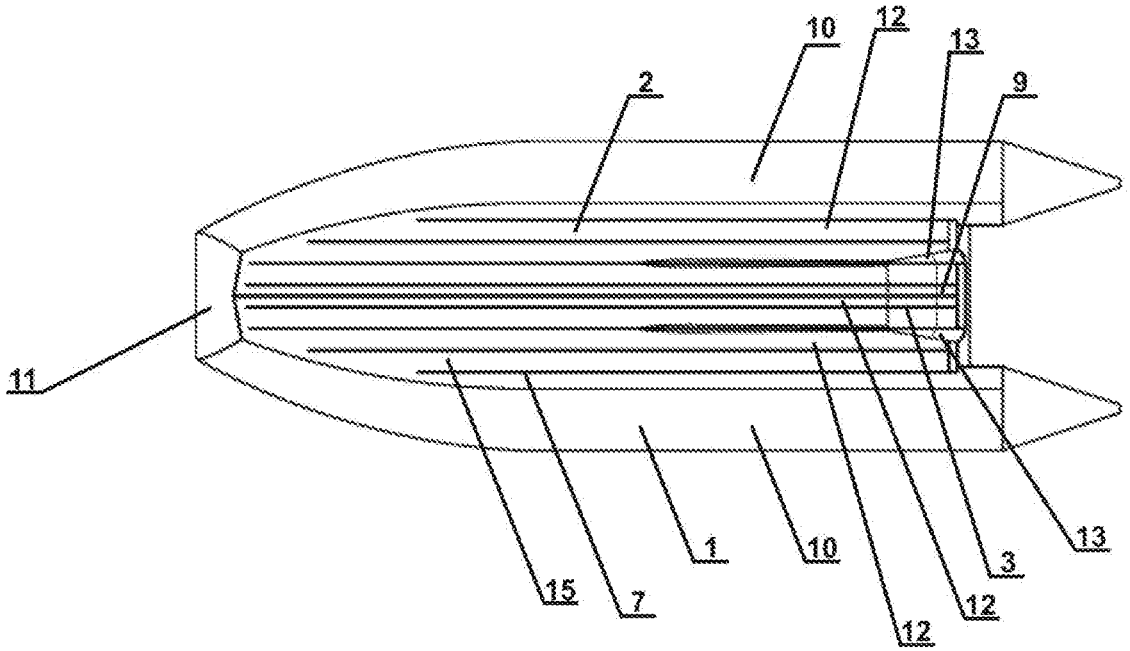
FIG. 2 is a bottom view of the inflatable motor boat.
Figure 3:
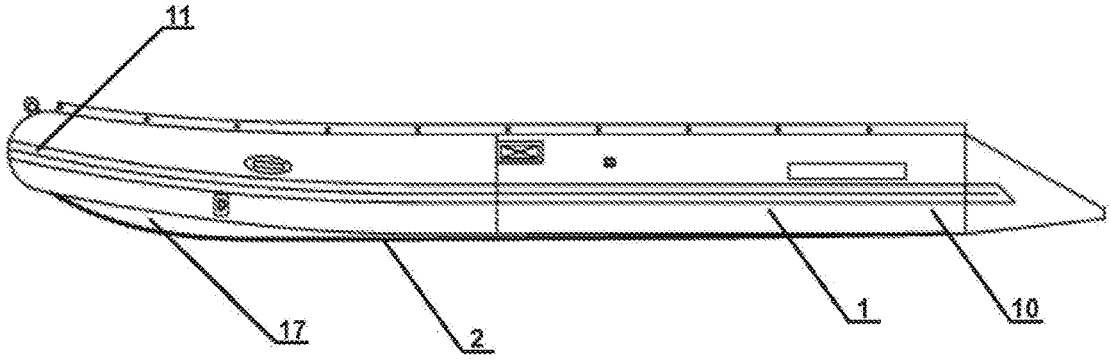
FIG. 3 is a side view of the boat.
Figure 4:
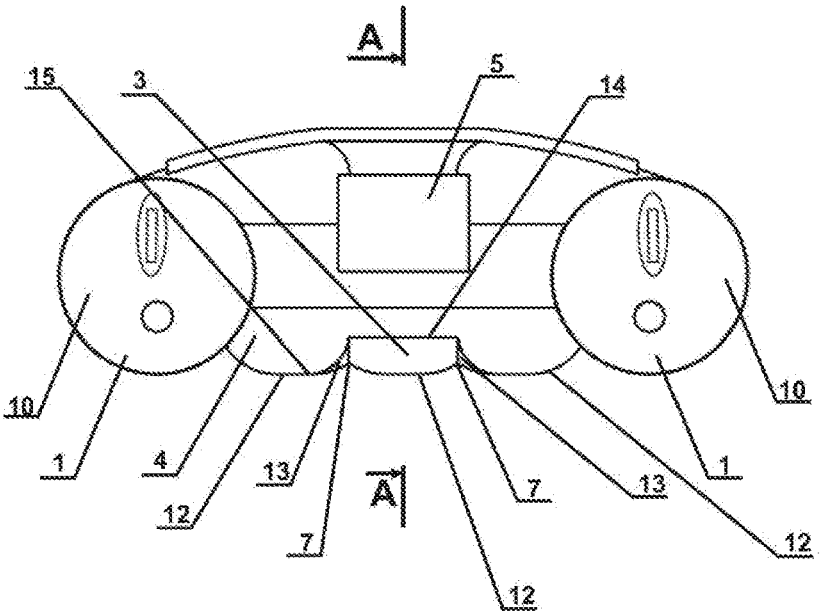
FIG. 4 shows a view of the inflatable motor boat from the stern side.

As indicated in FIGS. 1 to 4, an inflatable motor boat according to the present invention comprises a hull 1, an inflatable bottom 2 with a tunnel 3 and stern face 4 (as shown in FIG. 4), a transom 5 for mounting an outboard engine with a propeller (not shown in the drawing) thereon. Instead of the outboard engine with the propeller, a water jet engine with a water jet inlet (not shown in the drawing) can be mounted.

Figure 1:
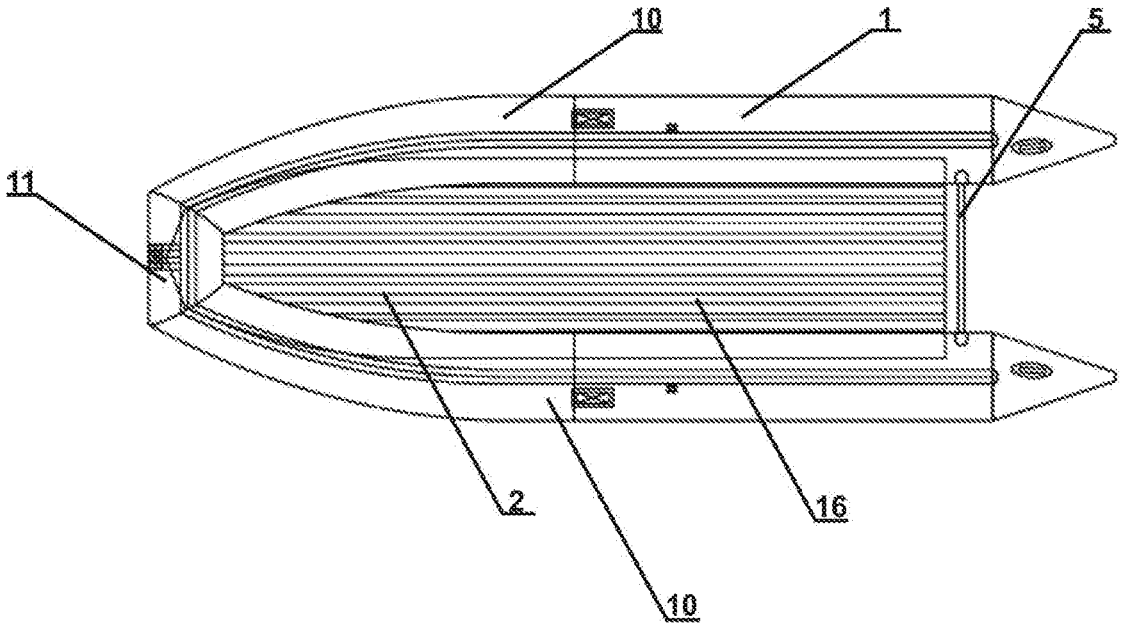
FIG. 1 is a top view of an inflatable motor boat.

As shown in FIG. 1 (top view of the inflatable motor boat), the hull 1 of the inflatable motor boat is formed by open outline of inflatable boards 10 and bow part 11. As shown in FIG. 2 and FIG. 3, the inflatable bottom 2 is attached to the hull 1. The inflatable bottom 2 can be attached to the hull 1 by any method known in the art, for example, glued, sewn, secured by lacing or soldered. As shown in FIG. 4, the stern face 4 is made on the inflatable bottom 2 from the stern side. In this case, the length of the bottom 2 from the bow part 11 to the stern face 4 is less than the length of the inflatable boards 10 of the hull 1, as shown in FIG. 1 and FIG. 2. Thus, the extreme points of the inflatable boards 10 of the hull 1 are located at a larger distance from the bow part 11 of the inflatable motor boat than the stern face 4 of the inflatable bottom 2. This configuration allows the boat to move in low water conditions, since the propeller of the outboard engine (not shown in the drawing) is located above the lower surface of the inflatable bottom 2.

Figure 5:
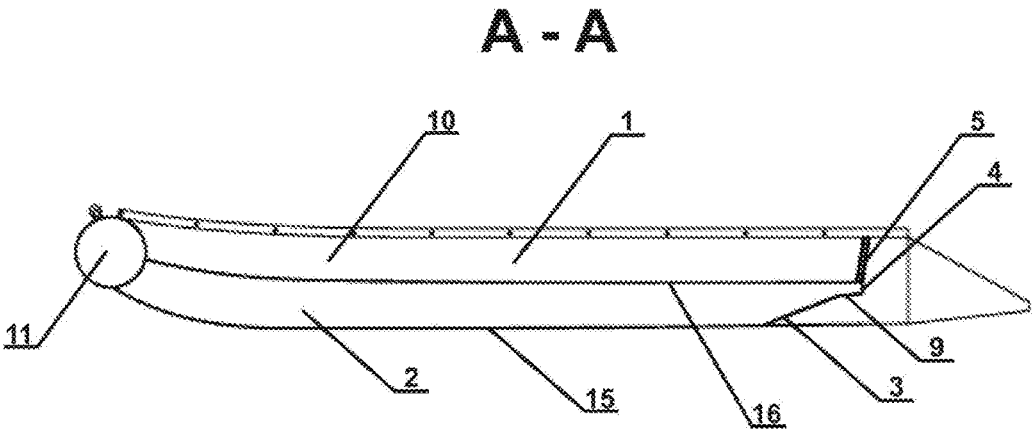
FIG. 5 shows a section of the inflatable motor boat along the line A-A, wherein the inclined tunnel 3 is provided with a wedge-shaped portion and an additional portion 9.

As shown in FIG. 2, the lower surface 15 of the inflatable bottom 2 is divided into at least three longitudinal segments 12. Moreover, the middle longitudinal segment 12 comprises a tunnel 3. The tunnel 3 is directed longitudinally. The tunnel 3 has at least three surfaces: the upper inclined surface of the tunnel 3 and the side walls 13 of the tunnel 3 conjugated thereto. The upper inclined surface of the tunnel 3 can form an angle from 5° to 45° with the water surface. The tunnel 3 itself is configured in such a way that its depth is reduced in the direction from the stern face 4 to the bow part 11 of the inflatable motor boat, as shown in FIG. 5. Moreover, as shown in FIG. 5, the tunnel 3 comprises a portion having a wedge-shaped form in a vertical section. The longitudinal direction of the tunnel 3, as shown in FIG. 5, allows water to fill the free volume of the tunnel 3 when the inflatable motor boat is moving, with minimal water resistance. This result is achieved in that the vertical plane of symmetry of the tunnel 3 coincides with the vertical plane of symmetry of the hull 1, which, in turn, coincides with the speed vector of the moving inflatable boat, as shown in FIG. 2 and FIG. 4. The location of the tunnel 3 in the middle longitudinal segment 12 of the inflatable bottom 2 ensures the stability of the moving boat.

Figure 8:
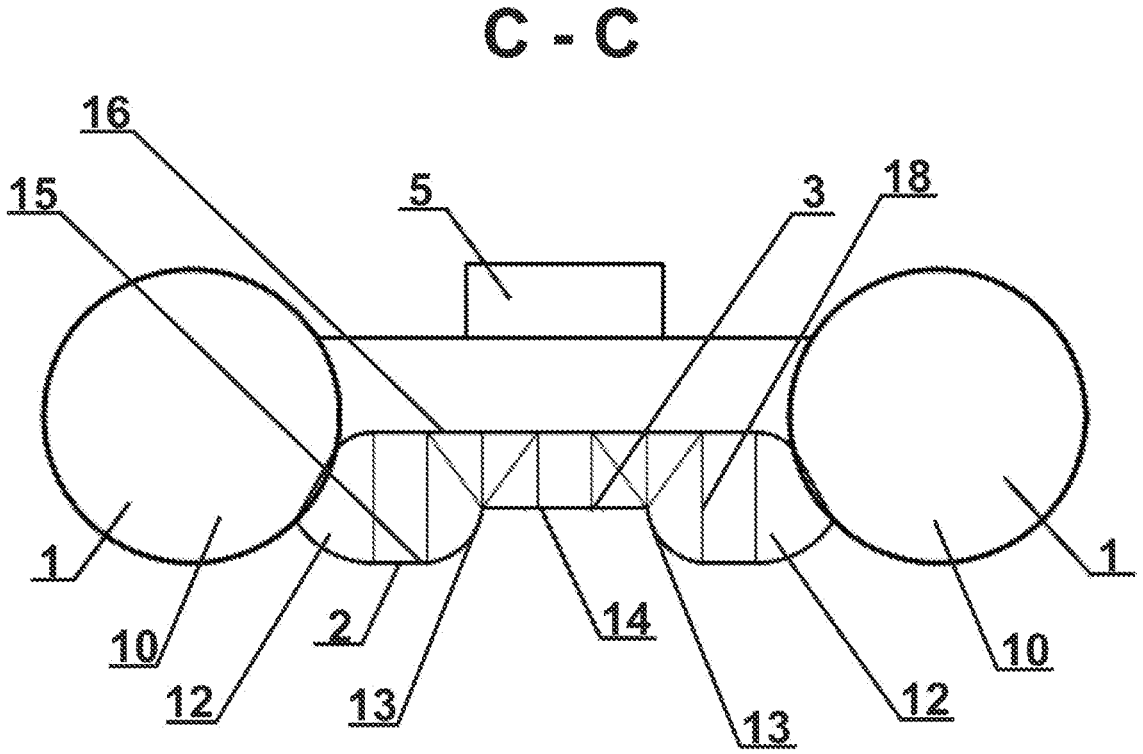
FIG. 8 shows the section of an inflatable motor boat along the line C-C.
Figure 9:
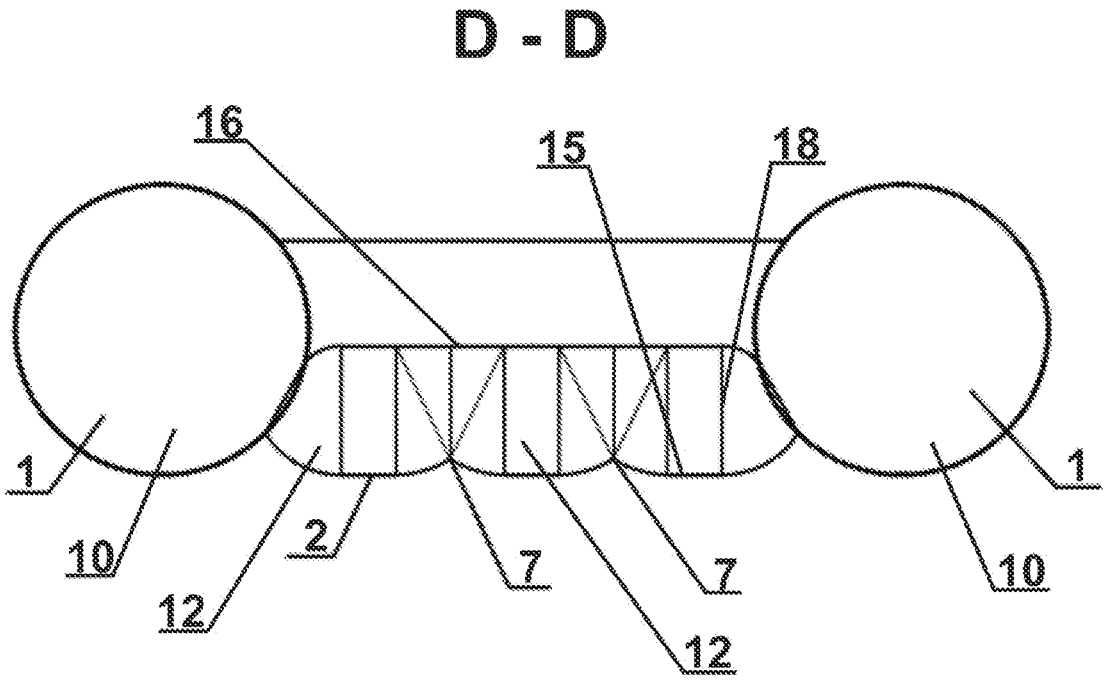
FIG. 9 shows the section of an inflatable motor boat along the line D-D.

As shown in FIG. 2, which illustrates a bottom view of the inflatable motor boat, and in FIG. 4, which illustrates a view of the inflatable motor boat from the stern side, the plane of symmetry of the inclined longitudinal tunnel 3 coincides with the vertical plane of symmetry of the hull 1, which is made U-shaped in plan view. The U-shaped configuration of the hull 1 in plan view, in turn, is shown in FIG. 1. At the same time, the depth of the inclined tunnel 3 is reduced in the direction from the stern face 4 located in the stern part of the boat to the bow part 11. Such a decrease in the depth of the inclined tunnel 3 is illustrated by cross sections along the lines C-C and D-D shown in FIG. 8 and FIG. 9, respectively. The section along the line D-D (FIG. 9) is located at a larger distance from the stern face 4 toward the how part 11 of the boat than the section along the line C-C (FIG. 8), and, naturally, the depth of the inclined tunnel 3 in FIG. 9 is less than the depth of the inclined tunnel 3 in FIG. 8.

The depth of the inclined tunnel 3 reducing in the direction from the stern face 4 to the bow part 11 of the inflatable motor boat and the longitudinal direction of the inclined tunnel 3 provide a smooth water motion vector at an upward angle with the supply of water in the required quantity to the propeller of the outboard engine (not shown in the drawing), with no occurrence of turbulence phenomenon at the location of the propeller (not shown in the drawing). This is achieved by filling the free volume of the tunnel 3 with water when the inflatable motor boat is moving, with minimal water resistance, due to the fact that the vertical plane of symmetry of the tunnel 3 coincides with the vertical plane of symmetry of the hull 1, which, in turn, coincides with the speed vector of the moving inflatable boat. Accordingly, the water flow at the outlet of the tunnel 3 is directed at an upward angle and enters the propeller of the outboard engine (not shown in the drawing) located in such a way that the water flow motion vector at the outlet of the inclined tunnel 3 passes through the axis of rotation of the propeller (not shown in the drawing).

As a possible embodiment of the present invention, the tunnel 3 comprises a portion having a wedge-shaped form in a vertical section, as shown in FIG. 5. Moreover, the tunnel 3 can also comprise an additional portion 9 with an angle of inclination from 0° to 20° relative to the water surface plane and lower surface 15 of the inflatable bottom 2, respectively. An additional portion 9 is located between the portion having a wedge-shaped form in a vertical section and the stern face 4, as shown in a longitudinal section along the line A-A in FIG. 5.

The positioning of the additional portion 9 in the inclined longitudinal tunnel 3 relative to the stern face 4 is also shown in FIG. 2. Moreover, the length of the additional portion 9 is less than the length of the portion having a wedge-shaped form in a vertical section. Thus, the upper inclined surface of the tunnel 3 has a variable angle of inclination relative to the water surface, that is, the decrease in the depth of the inclined longitudinal tunnel 3 in the direction from the stern face 4 to the bow part 11 of the boat is made non-uniform. The inclination angle of the additional portion 9 cannot be more than 20° relative to the water surface plane and lower surface 15 of the inflatable bottom 2, respectively.

Such a design of the tunnel 3 provided with the wedge-shaped portion and the additional portion 9 and conjugated with the stern face 4 provides a gradual change in the angle of inclination of the water flow relative to the water surface plane inside the tunnel 3 when the inflatable motor boat is moving. At first, water enters the inclined longitudinal tunnel 3, namely, the wedge-shaped portion. Then the water flow changes the angle of inclination at the joint place between the wedge-shaped portion of the tunnel 3 and the additional portion 9 of the tunnel 3. Thus, the possibility of the water flow disruption at the inflection points is excluded.

Such a motion of the water flow inside the inclined longitudinal tunnel 3 comprising the wedge-shaped portion and the additional portion 9 provides a smooth water motion vector at an upward angle with the supply of water in the required quantity to the propeller of the outboard engine (not shown in the drawing), with no occurrence of turbulence phenomenon at the location of the propeller (not shown in the drawing), due to the fact that the water flow motion vector at the outlet of the inclined tunnel 3 conjugated with the stern face 4 passes through the axis of rotation of the propeller (not shown in the drawing). Also, such a motion of the water flow inside the inclined longitudinal tunnel 3 comprising the wedge-shaped portion and the additional portion 9 provides a smooth moving of the boat at the time of coming onto plane (into gliding), which ensures high-performance boating, including in low water conditions.

As shown in FIG. 4, the angle of inclination of the tangent to the side wall 13 of the tunnel 3 relative to the water surface plane can be no more than 45° from the vertical line. This allows to make the side walls 13 in such a way that the width of the tunnel 3 in a cross section is reduced in the direction from the lower surface 15 of the inflatable bottom 2 to the upper inclined surface of the tunnel 3 conjugated with its side walls 13. Such a configuration allows to raise the water flow inside the tunnel 3 when the claimed inflatable boat is moving and provide the necessary water flow density for trouble-free operation of the outboard engine (not shown in the drawing).

Due to the fact that the angle of inclination of the tangent to the side wall 13 of the tunnel 3 relative to the water surface plane can be no more than 45° from the vertical line, the inner surface of the tunnel 3 has essentially arc-shaped form, since the shape of the side walls 13 and the upper inclined surface of the tunnel 3 in the inflated state becomes rounded. Accordingly, the cross-sectional shape of the inner surface of the tunnel 3 is essentially arc-shaped, as shown in FIG. 4. Nevertheless, in view of the structural features of the boat, namely the fact that the elements of the bottom 2 are connected to each other by means of seams 18, the joint places between the side walls 13 and the upper inclined surface of the tunnel 3 are presented by small natural recesses. This feature is manifested throughout the length of the longitudinal tunnel 3, including at the conjugation line 14 between the stern face 4 and the longitudinal tunnel 3. The presence of seams 18 in the design of the claimed invention ensures reliable connection of the parts of the material the inflatable bottom 2 is made from.

The fact, that the inner surface of the longitudinal tunnel 3 has essentially arc-shaped form, provides sticking of the water flow inside the tunnel when the boat is moving, and therefore, the effective water supply from the tunnel 3 to the propeller of the outboard engine (not shown in the drawing).

The shape of the conjugation line 14 between the stern face 4 and the longitudinal tunnel 3, comprising the wedge-shaped portion, is essentially arc-shaped, as shown in FIG. 4. However, in view of the above-described features of connecting the elements of the inflatable bottom 2 using seams 18, the shape of the conjugation line 14 between the stern face 4 and the longitudinal tunnel 3 can be made trapezoidal or Π-shaped, which is seen from the stern side in FIG. 4. In this case, the conjugation line 14 between the stern face 4 and the longitudinal tunnel 3 can be made trapezoidal if the angle of inclination of the tangent to the side wall 13 of the tunnel 3 relative to the water surface plane is from 0° to 45° from the vertical line. If the tangent to the side wall 13 of the tunnel 3 is perpendicular to the water surface plane, that is, the angle of inclination of the tangent is 0° from the vertical line, the shape of the conjugation line 14 between the stern face 4 and the longitudinal tunnel 3 can be made Π-shaped.

At the same time, the portion of the conjugation line 14, adjacent to the inclined plane of the longitudinal tunnel 3, can be curved toward the water surface plane and the lower surface 15 of the inflatable bottom 2, respectively. This makes it possible to raise water flow and provide the necessary water flow density for trouble-free operation of the outboard engine (not shown in the drawing), which ensures high efficiency of the inflatable boat use in low water conditions.

In this case, the side walls 13 of the inclined tunnel 3 can be made curved toward the free volume, as shown in FIG. 4. This makes it possible to additionally raise the water flow inside the tunnel 3 and provides the necessary water flow density for trouble-free operation of the outboard engine (not shown in the drawing).

The lower surface 15 of the inflatable bottom 2, namely, the surface located in the lower part of the inflatable bottom 2 and contacting the water surface plane when the inflatable motor boat is moving, can comprise longitudinal grooves 7, as shown in FIG. 2 and FIG. 4. The presence of the longitudinal grooves 7 in the configuration of the lower surface 15 of the inflatable bottom 2 with the location on the lower surface of the seams 18 connecting the parts of the material the inflatable bottom 2 is made from. The presence of seams 18 in the configuration of the claimed invention ensures the reliability of the connection of the parts of the material the inflatable bottom 2 is made from. As shown in FIG. 8 and FIG. 9, each showing the layout from the stern side of a section along the lines C-C and D-D, respectively, the seams 18 are located vertically inside the inflatable bottom 2. Also, the seams 18 inside the inflatable bottom 2 can be inclined, which is also depicted in FIG. 8 and FIG. 9. Accordingly, the presence of seams 18 on the lower surface 15 of the inflatable bottom 2 will result in the formation of the longitudinal grooves 7 in the inflated state, as shown in FIG. 9, wherein the longitudinal grooves 7 are located at the joint place between the vertical and inclined seams 18 and the lower surface 15 of the inflatable bottom 2.

In the claimed invention, a transom 5 can be installed on the upper surface 16 of the inflatable bottom 2, above the stern face 4, as shown in FIG. 5, hi turn, an outboard engine with a propeller (not shown in the drawing) can be mounted on the transom 5. Such a design of the inflatable boat allows using the outboard engines with a shorter «leg» (381 mm) and positioning the propeller (not shown in the drawing) closer to the water surface plane, i.e. above the draft aft of the boat itself. In this case, the total depth of the vehicle immersion into water is reduced, which makes it possible to use it on the shallows, at low water, etc.

The inflatable bottom 2 can be made of any known design. As an example, the inflatable bottom 2 can be flat or can be provided with a keel 17. An embodiment of the inflatable boat equipped with the keel 17 is shown in FIG. 3, which illustrates a side view of the inflatable boat.

The possibility of using outboard engines with the shorter "leg" (381 mm) is provided by the configuration of the tunnel 3 comprising the wedge-shaped portion and the additional portion 9 and conjugated with the stern face 4, providing a gradual change in the angle of inclination of the water flow relative to the water surface plane inside the tunnel 3 when the inflatable motor boat is moving. At first, water enters the inclined longitudinal tunnel 3, namely, the wedge-shaped portion. Then the water flow changes the angle of inclination at the joint place between the wedge-shaped portion of the tunnel 3 and the additional portion 9 of the tunnel 3. Thus, the possibility of the water flow disruption at the inflection points is excluded.

Such a motion of the water flow inside the inclined longitudinal tunnel 3 comprising the wedge-shaped portion and the additional portion 9 provides a smooth water motion vector at an upward angle with the supply of water in the required quantity to the propeller of the outboard engine (not shown in the drawing), with no occurrence of turbulence phenomenon at the location of the propeller (not shown in the drawing), due to the fact that the water flow motion vector at the outlet of the inclined tunnel 3 conjugated with the stern face 4 passes through the axis of rotation of the propeller (not shown in the drawing). Also, such a motion of the water flow inside the inclined longitudinal tunnel 3 comprising the wedge-shaped portion and the additional portion 9 provides a smooth moving of the boat at the time of coming onto plane (into gliding), which ensures high-performance boating, including in low water conditions.

As one of the possible embodiments, the claimed invention is implemented as follows.

Figure 7:
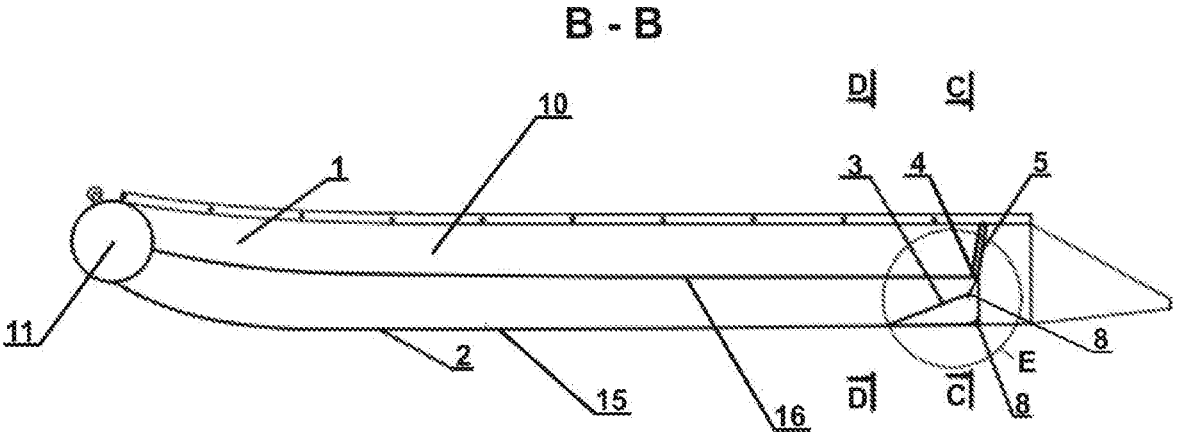
FIG. 7 shows the section of an inflatable motor boat along the line B-B.

As shown in FIG. 7, an inflatable motor boat in the context of this embodiment of the invention comprises a hull 1, an inflatable bottom 2 with a tunnel 3 and stern face 4, and a transom 5. An outboard engine with a propeller (not shown in the drawing) is mounted on the inflatable boat. Instead of the outboard engine with the propeller (not shown in the drawing), a water jet engine with a water jet inlet (not shown in the drawing) can be mounted.

Figure 6:
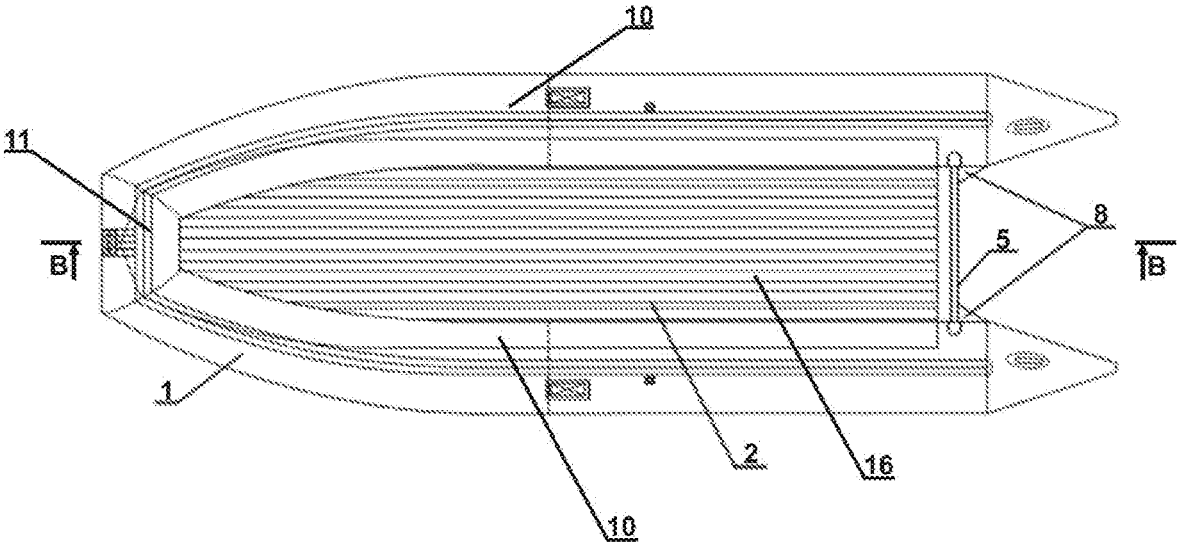
FIG. 6 shows the inflatable motor boat equipped with transom plates 8, a top view.

As shown in FIG. 6 (the inflatable motor boat equipped with the inclined stern face 4, a top view), the hull 1 of the inflatable motor boat is formed by open outline of inflatable boards 10 and how part 11. As shown in FIGS. 7 to 9, the inflatable bottom 2 is attached to the hull 1. The inflatable bottom 2 can be attached to the hull 1 by any method known in the art, for example, glued, sewn, secured using lacing or soldered. As shown in FIG. 7, the stern face 4 is made on the inflatable bottom 2 from the stern side. The stern face 4 can be made with rounded corners, oval, and, moreover, it can be reinforced, that is, it can be made multilayer or having a plate (not shown) in the place of getting off the incoming water flow.

Figure 11:
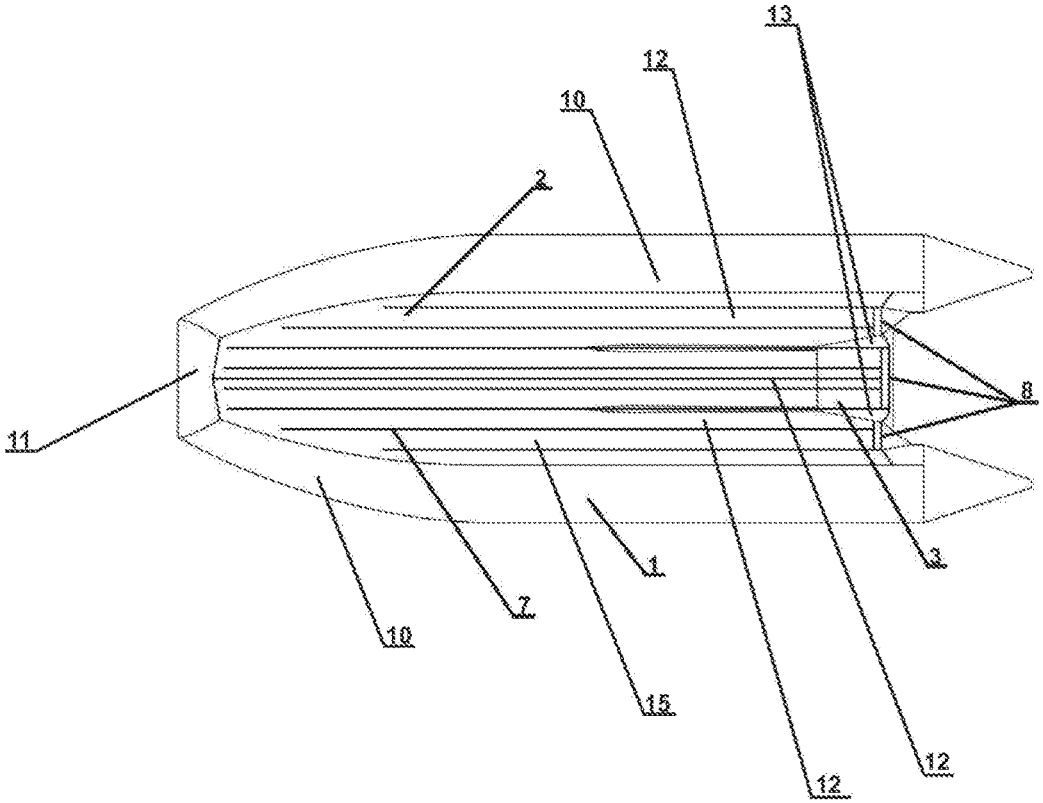
FIG. 11 shows the inflatable motor boat equipped with transom plates 8, a bottom view.

The length of the bottom 2 from the bow part 11 to the stern face 4 is less than the length of the inflatable boards 10 of the hull 1, which is shown in FIG. 6, FIG. 7 (a longitudinal section of the boat along the line B-B) and in FIG. 11 (the inflatable motor boat provided with an inclined stern face 4, a bottom view). Thus, the extreme points of the inflatable boards 10 of the hull 1 are located at a larger distance from the bow part 11 of the inflatable motor boat than the stern face 4 of the inflatable bottom 2. This configuration is inherent in any embodiment of the claimed invention and allows the boat to move in low water conditions, since the propeller of the outboard engine (not shown in the drawing) of the boat is located above the lower surface 15 of the inflatable bottom 2.

As shown in FIG. 11, the lower surface 15 of the inflatable bottom 2 is divided into at least three longitudinal segments 12. Moreover, the middle longitudinal segment 12 comprises a tunnel 3. The tunnel 3 is made longitudinal. The tunnel 3 has at least three surfaces: the upper inclined surface of the tunnel 3 and the side walls 13 of the tunnel 3 conjugated thereto. The upper inclined surface of the tunnel 3 can form an angle from 5° to 45° with the water surface plane. The tunnel 3 itself is configured in such a way that its depth is reduced in the direction from the stern face 4 to the bow part 11 of the inflatable motor boat, as shown in FIG. 7. Moreover, as shown in FIG. 7, the tunnel 3 comprises a portion having a wedge-shaped form in a vertical section. The longitudinal direction of the tunnel 3, as shown in FIG. 7, allows water to fill the free volume of the tunnel 3 when the inflatable motor boat is moving, with minimal water resistance. This result is achieved due to the fact that the vertical plane of symmetry of the tunnel 3 coincides with the vertical plane of symmetry of the hull 1, which, in turn, coincides with the speed vector of the moving inflatable boat, as shown in FIG. 8 and FIG. 11. The location of the tunnel 3 in the middle longitudinal segment 12 of the inflatable bottom 2 ensures the stability of the moving boat.

As shown in FIG. 8, which illustrates a section of the inflatable motor boat provided with an inclined stern face 4, along the line C-C and in FIG. 11, which illustrates a bottom view of the inflatable motor boat, the plane of symmetry of the inclined longitudinal tunnel 3 coincides with the vertical plane of symmetry of the hull 1, which is made U-shaped in plan view. The configuring of the hull 1 U-shaped in plan view, in turn, is shown in FIG. 6. In this case, the depth of the inclined tunnel 3 is reduced in the direction from the stern face 4 located in the stern part of the boat to the bow part 11. Such a decrease in the depth of the inclined tunnel 3 is illustrated by cross sections along the lines C-C and D-D shown in FIG. 8 and FIG. 9, respectively. The section along the line D-D (FIG. 9) is located at a larger distance from the stern face 4 toward the bow part 11 of the boat than the section along the line C-C (FIG. 8), and, naturally, the depth of the inclined tunnel 3 in FIG. 9 is less than the depth of the inclined tunnel 3 in FIG. 8.

The depth of the inclined tunnel 3 reducing in the direction from the stern face 4 to the bow part 11 of the inflatable motor boat and the longitudinal direction of the inclined tunnel 3 provide a smooth water motion vector at an upward angle with the supply of water in the required quantity to the propeller of the outboard engine (not shown in the drawing), with no occurrence of turbulence phenomenon at the location of the propeller (not shown in the drawing). This is achieved by filling the free volume of the tunnel 3 with water when the inflatable motor boat is moving, with minimal water resistance, due to the fact that the vertical plane of symmetry of the tunnel 3 coincides with the vertical plane of symmetry of the hull 1, which, in turn, coincides with the speed vector of the moving inflatable boat. Accordingly, the water flow at the outlet of the tunnel 3 is directed at an upward angle and enters the propeller of the outboard engine (not shown in the drawing), Which is located in such a way that the water flow motion vector at the outlet of the inclined tunnel 3 passes through the axis of rotation of the propeller (not shown in the drawing).

In the context of this embodiment of the claimed invention, the stern face 4 of the inflatable bottom 2 can be made inclined. In this case, the angle of inclination of the stern face 4 is less than 90° relative to the water surface plane and lower surface 15 of the inflatable bottom 2, respectively, as shown in FIG. 7. In turn, the inclined stern face 4 is conjugated with the inclined longitudinal tunnel 3, as shown in FIG. 7, and the inclined longitudinal tunnel 3 comprising a wedge-shaped portion is located in the middle segment 12 of the inflatable bottom 2, as shown in FIG. 11.

Such a configuration of the tunnel 3 conjugated with an inclined stern face 4 provides a gradual change in the angle of inclination of the water flow relative to the water surface plane inside the tunnel 3, and then along the inclined stern face 4 when the inflatable motor boat is moving. At first, the water enters the inclined longitudinal tunnel 3 comprising the wedge-shaped portion. Then the water flow changes the angle of inclination at the conjugation line 14 between the inclined tunnel 3 and the inclined stern face 4 of the inflatable bottom 2. Thus, the possibility of the water flow disruption at the inflection points is eliminated.

Such a motion of the water flow inside the longitudinally inclined tunnel 3 comprising the wedge-shaped portion, and then along the inclined stern face 4 provides a smooth water motion vector at an upward angle with the supply of water in the required quantity to the propeller of the outboard engine (not shown in the drawing), with no occurrence of turbulence phenomenon at the location of the propeller (not shown in the drawing), due to the fact that the water flow motion vector at the outlet of the inclined tunnel 3 along the inclined stern face 4 passes through the axis of rotation of the propeller (not shown in the drawing). Also, such a motion of the water flow inside the inclined longitudinal tunnel 3 comprising the wedge-shaped portion, and then along the inclined stern face 4, provides a smooth moving of the boat at the time of coming onto plane (into gliding), which ensures high-performance boating, including in low water conditions.

As shown in FIG. 8, the angle of inclination of the tangent to the side wall 13 of the tunnel 3 relative to the water surface can be no more than 45° from the vertical line. This allows to configure the side walls 13 in such a way that the width of the tunnel 3 in a cross section is reduced in the direction from the lower surface 15 of the inflatable bottom 2 to the upper inclined surface of the tunnel 3 conjugated with its side walls 13. Such a configuration allows to raise the water flow inside the tunnel 3 when the claimed inflatable boat is moving and provide the necessary water flow density for trouble-free operation of the outboard engine (not shown in the drawing).

Due to the fact that the angle of inclination of the tangent to the side wall 13 of the tunnel 3 with respect to the surface of the water can be no more than 45° from the vertical line, the inner surface of the tunnel 3 has essentially arc-shaped form, since the shape of the side walls 13 and the upper inclined surface tunnel 3 in the inflated state becomes rounded. Accordingly, the cross-sectional shape of the inner surface of the tunnel 3 is essentially arc-shaped, as shown in FIG. 8. Nevertheless, in view of the structural features of the boat, namely the fact that the elements of the bottom 2 are connected to each other by means of seams 18, the joint places between the side walls 13 and the upper inclined surface of the tunnel 3 are presented by small natural recesses. This feature is manifested throughout the length of the longitudinal tunnel 3, including at the conjugation line 14 between the stern face 4 and the longitudinal tunnel 3. The presence of the seams 18 in the configuration of the claimed invention ensures reliable connection of the parts of the material the inflatable bottom 2 is made from.

The shape of the conjugation line 14 between the stern face 4 and the longitudinal tunnel 3 comprising the wedge-shaped portion is essentially arc-shaped, as shown in FIG. 8. However, in view of the above-described features of connecting the elements of the inflatable bottom 2 by means of seams 18, the shape of the conjugation line 14 between the stern face 4 and the longitudinal tunnel 3 can be trapezoidal or Π-shaped, which is shown from the stern side in FIG. 8. In this case, the conjugation line 14 between the stern face 4 and the longitudinal tunnel 3 can be trapezoidal if the angle of inclination of the tangent to the side wall 13 of the tunnel 3 relative to the water surface plane is from 0° to 45° from the vertical line. If the tangent to the side wall 13 of the tunnel 3 is perpendicular to the water surface plane, that is, the angle of inclination of the tangent is 0° from the vertical line, the shape of the conjugation line 14 between the stern face 4 and the longitudinal tunnel 3 can be made Π-shaped.

At the same time, the portion of the conjugation line 14, adjacent to the inclined plane of the longitudinal tunnel 3, can be bent toward the plane of the lower surface 15 of the inflatable bottom 2. This makes it possible to raise the water flow and provide the necessary water flow density for trouble-free operation of the outboard engine (not shown in the drawing), which ensures high efficiency of the inflatable boat use in low water conditions.

The fact, that the inner surface of the longitudinal tunnel 3 has essentially arc-shaped form, provides sticking of the water flow inside the tunnel when the boat is moving, which means the effective water supply from the tunnel 3 to the propeller of the outboard engine (not shown in the drawing).

In this case, the side walls 13 of the inclined tunnel 3 can be made curved toward the free volume, as shown in FIG. 8. This makes it possible to additionally raise the water flow inside the tunnel 3 and provide the necessary water flow density for trouble-free operation of the outboard engine (not shown in the drawing).

The lower surface 15 of the inflatable bottom 2, namely, the surface located in the lower part of the inflatable bottom 2 and contacting with the water surface plane when the inflatable motor boat is moving, can comprise longitudinal grooves 7, as shown in FIG. 9 and FIG. 11. The presence of longitudinal grooves 7 in the configuration of the lower surface 15 of the inflatable bottom 2 with the location on the lower surface 15 of the seams 18 connecting the parts of the material the inflatable bottom 2 is made from. The presence of seams 18 in the configuration of the claimed invention ensures the reliability of the connection of the parts of the material the inflatable bottom 2 is made from. As shown in FIG. 8 and FIG. 9, each showing layout of a section along the lines C-C and D-D from the stern side, respectively, the seams 18 are located vertically inside the inflatable bottom 2. Also, the seams 18 inside the inflatable bottom 2 can be inclined, which is also depicted in FIG. 8 and FIG. 9. Accordingly, the presence of seams 18 on the lower surface 15 of the inflatable bottom 2 will result in the formation of the longitudinal grooves 7 in the inflated state, as shown in FIG. 9, wherein the longitudinal grooves 7 are located at the joint places between the vertical and inclined seams 18 and the lower surface 15 of the inflatable bottom 2.

In the claimed invention, a transom 5 is installed on the upper surface 16 of the inflatable bottom 2, above the stern face 4, as shown in FIG. 7. In turn, an outboard engine with a propeller (not shown in the drawing) is mounted on the transom 5. Such a design of the inflatable boat allows the using of outboard engines with a shorter "leg" (381 mm) and positioning the propeller (not shown in the drawing) closer to the water surface plane, above the draft aft of the boat itself. At the same time, the total depth of the vehicle immersion into water is reduced, which makes it possible to use it on the shallows, at low water, etc.

The possibility of using outboard engines with the shorter "leg" (381 mm) is provided by the configuration of the tunnel 3 conjugated with the inclined stern face 4, which provides a gradual change in the angle of inclination of the water flow relative to the water surface plane inside the tunnel 3, and then along the inclined stern face 4 when the inflatable motor boat is moving. At first, the water enters the inclined longitudinal tunnel 3 comprising the wedge-shaped portion. Then the water flow changes the angle of inclination at the conjugation line 14 between the inclined tunnel 3 and the inclined stern face 4 of the inflatable bottom 2. Thus, the possibility of the water flow disruption at the inflection points is eliminated.

Such a motion of the water flow inside the longitudinally inclined tunnel 3 comprising the wedge-shaped portion, and then along the inclined stern face 4 provides a smooth water motion vector at an upward angle with the supply of water in the required quantity to the propeller of the outboard engine (not shown in the drawing), with no occurrence of turbulence phenomenon at the location of the propeller (not shown in the drawing). Also, such a motion of the water flow inside the inclined longitudinal tunnel 3 comprising the wedge-shaped portion, and then along the inclined stern face 4, provides a smooth moving of the boat at the time of coming onto plane (into gliding), which ensures high-performance boating, including in low water conditions.

Such a configuration allows positioning the propeller of the outboard engine (not shown in the drawing) in such a way that the speed vector of the inflatable motor boat coincides with the outboard engine thrust vector (not shown in the drawing) and the axis of rotation of the propeller (not shown in the drawing), respectively, and was directed to the center of mass of the inflatable motor boat. This results in a smooth moving of the inflatable motor boat and allows to eliminate the effect of the boat oscillating in a vertical plane when in motion, for example, at the time of coming onto plane (into gliding). It follows that this configuration is optimal for the location of the propeller of the outboard engine (not shown in the drawing), which allows to eliminate the risk of damage to the propeller (not shown in the drawing) and improves the efficiency of the boat use in low water conditions.

As shown in FIG. 7, the inflatable bottom 2 can be further provided with at least one transom plate 8. As an example, the transom plate 8 can have the shape of a triangle, as shown in FIG. 11 (bottom view) and partially shown in FIG. 6 (top view).

Figure 10:
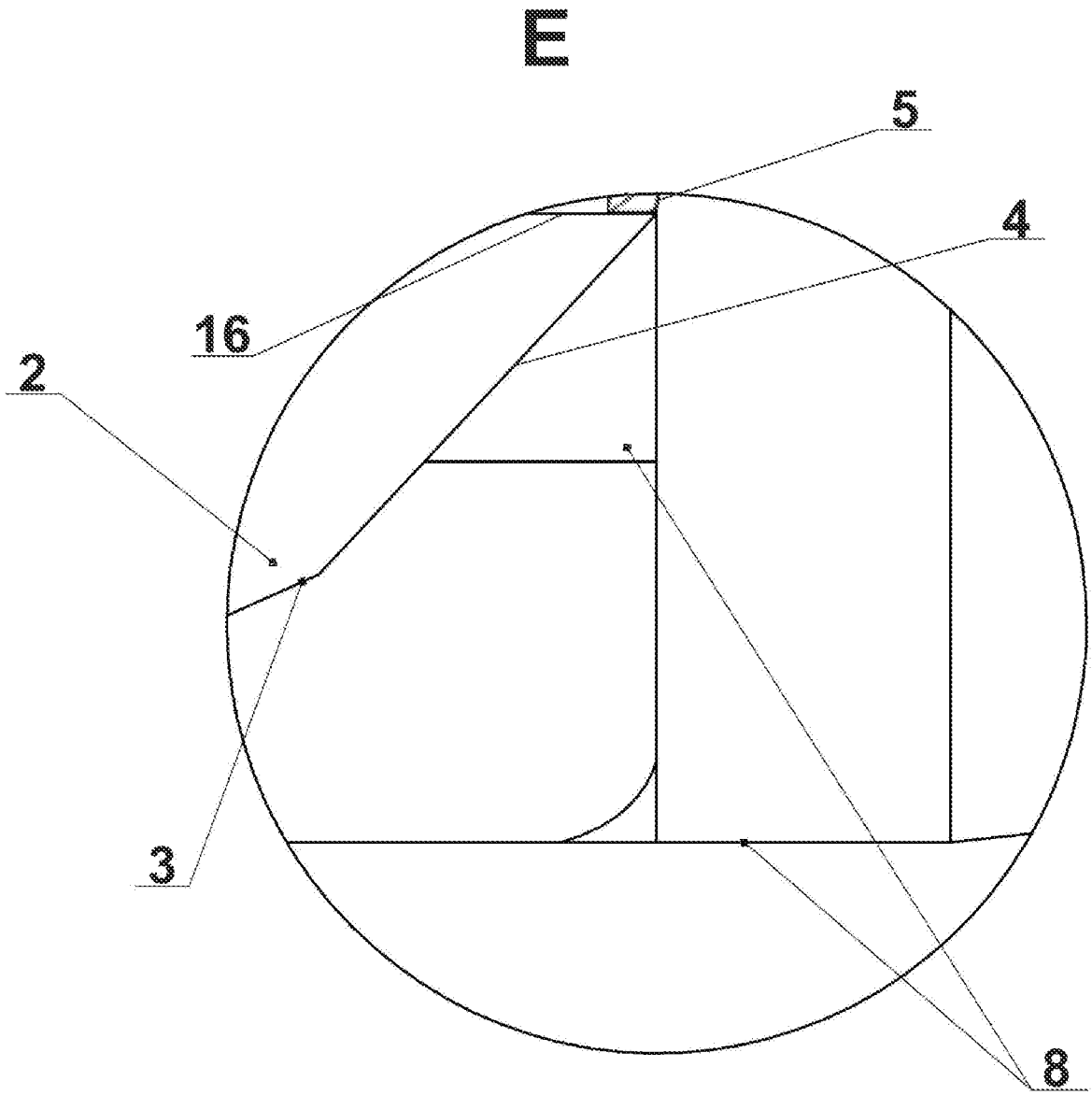
FIG. 10 illustrates a region showing transom plates 8.

As an example, the inflatable bottom 2 can be further provided with three transom plates 8, as shown in FIG. 11, wherein the edges of the transom plates 8 are located within the outer contour of the stern face 4 and the inflatable boards 10 of the hull 1. The location of the transom plates 8 is also illustrated in FIG. 10, namely, the region E indicated in the area of the stern face 4.

The providing of the inflatable bottom 2 with at least one transom plate 8 allows to avoid drawdown of the stern part of the inflatable boat when the boat is coming onto plane (into gliding) and ensures stable moving of the inflatable motor boat. This aspect is important in the case of use the inventive inflatable motor boat in low water conditions, as it helps to prevent damage to the propeller of the outboard engine (not shown in the drawing).

The inflatable bottom 2 can be made of any known design. As an example, the inflatable bottom 2 can be made flat or can be provided with a keel 17. An embodiment of the inflatable boat equipped with the keel 17 is shown in FIG. 3, which illustrates a side view of the inflatable boat.

As another possible option, the claimed invention is implemented as follows.

Figure 14:
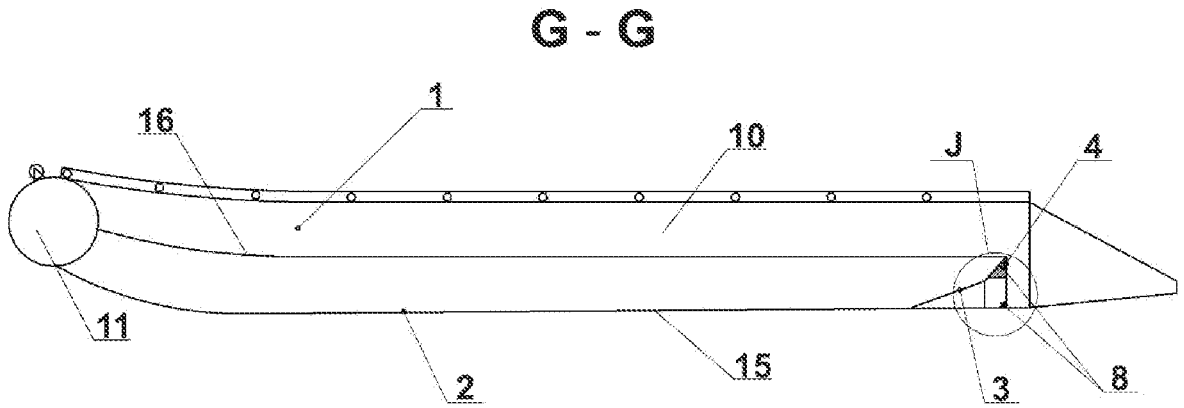
FIG. 14 illustrates a section of the inflatable motor boat along the line G-G showing an inclined stern face 4.

As shown in FIG. 14, an inflatable motor boat in the context of this embodiment of the invention comprises a hull 1, an inflatable bottom 2 with a tunnel 3 and stern face 4, and a transom (not shown in the drawing). An outboard engine with a propeller (not shown in the drawing) is mounted on the inflatable boat. Instead of the outboard engine with the propeller, a water jet engine with a water jet inlet (not shown in the drawing) can be mounted.

Figure 18:
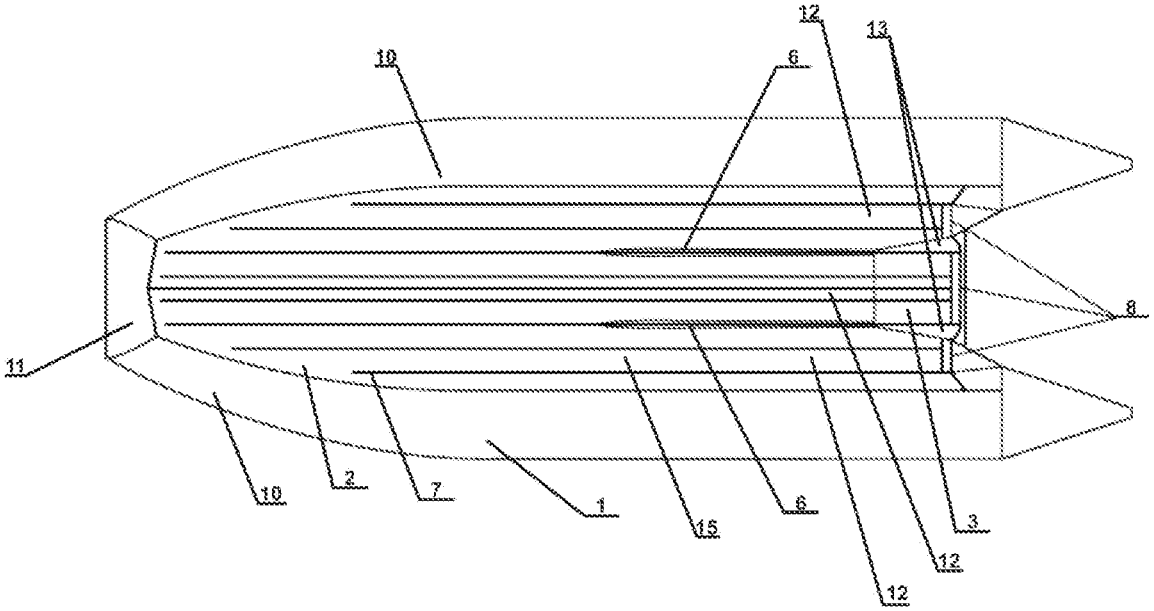
FIG. 18 shows the inflatable motor boat provided with water channels 6, a bottom view.

As shown in FIG. 18 (inflatable motor boat provided with water channels 6, a bottom view), the hull 1 of the inflatable motor boat is formed by open outline of inflatable boards 10 and bow part 11. As shown in FIGS. 12 to 16, the inflatable bottom 2 is attached to the hull 1. The inflatable bottom 2 can be attached to the hull 1 by any method known in the art, for example, glued, sewn, secured by lacing or soldered. As shown in FIG. 13 and FIG. 14, the stern face 4 is made on the inflatable bottom 2 from the stern side. In this case, the length of the bottom 2 from the bow part 11 to the stern face 4 is less than the length of the inflatable boards 10 of the hull 1, as shown in FIG. 13 (a longitudinal section of the boat along the line a side view), FIG. 14 (a longitudinal section of the boat along the line a side view), and FIG. 18 (the inflatable motor boat provided with water channels 6, a bottom view). Thus, the extreme points of the inflatable boards 10 of the hull 1 are located at a larger distance from the bow part 11 of the inflatable motor boat than the stern face 4 of the inflatable bottom 2. This configuration allows the boat to move in low water conditions, since the propeller (not shown in the drawing) of the outboard engine is located above the lower surface 15 of the inflatable bottom 2.

Figure 15:
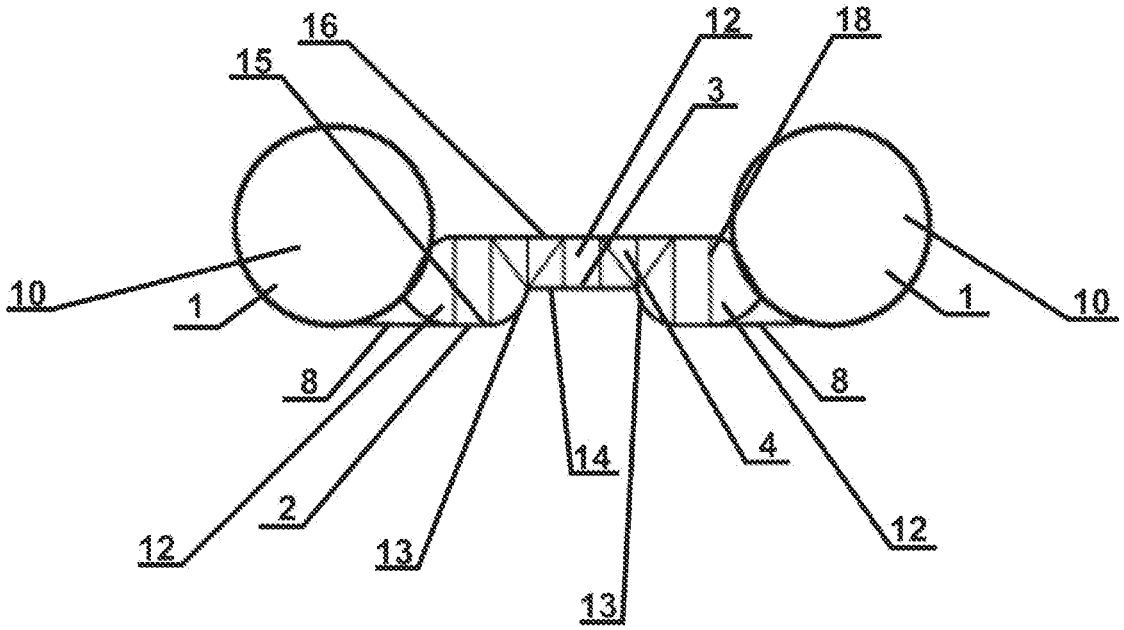
FIG. 15 shows a section of the inflatable motor boat along the line H-H.

As shown in FIG. 18, the lower surface 15 of the inflatable bottom 2 is divided into at least three longitudinal segments 12. In this case, the middle longitudinal segment 12 comprises the tunnel 3. The tunnel 3 is directed longitudinally. The tunnel 3 has at least three surfaces: the upper inclined surface of the tunnel 3 and the side walls 13 of the tunnel 3 conjugated thereto. The upper inclined surface of the tunnel 3 can form an angle from 8° to 42° with the water surface plane. The tunnel 3 itself is configured in such a way that its depth is reduced in the direction from the stern face 4 to the bow part 11 of the inflatable motor boat, as shown in FIG. 14. Moreover, as shown in FIG. 7, the tunnel 3 comprises a portion having a wedge-shaped form in a vertical section. The longitudinal direction of the tunnel 3 shown in FIG. 14 allows water to fill the free volume of the tunnel 3 when the inflatable motor boat is moving, with minimal water resistance. This result is achieved due to the fact that the vertical plane of symmetry of the tunnel 3 coincides with the vertical plane of symmetry of the hull 1, which, in turn, coincides with the speed vector of the moving inflatable boat, as shown in FIG. 15 (a section along the line H-H, a view from the stern side) and FIG. 18, The location of the tunnel 3 in the middle longitudinal segment 12 of the inflatable bottom 2 ensures the stability of the moving boat.

Figure 16:
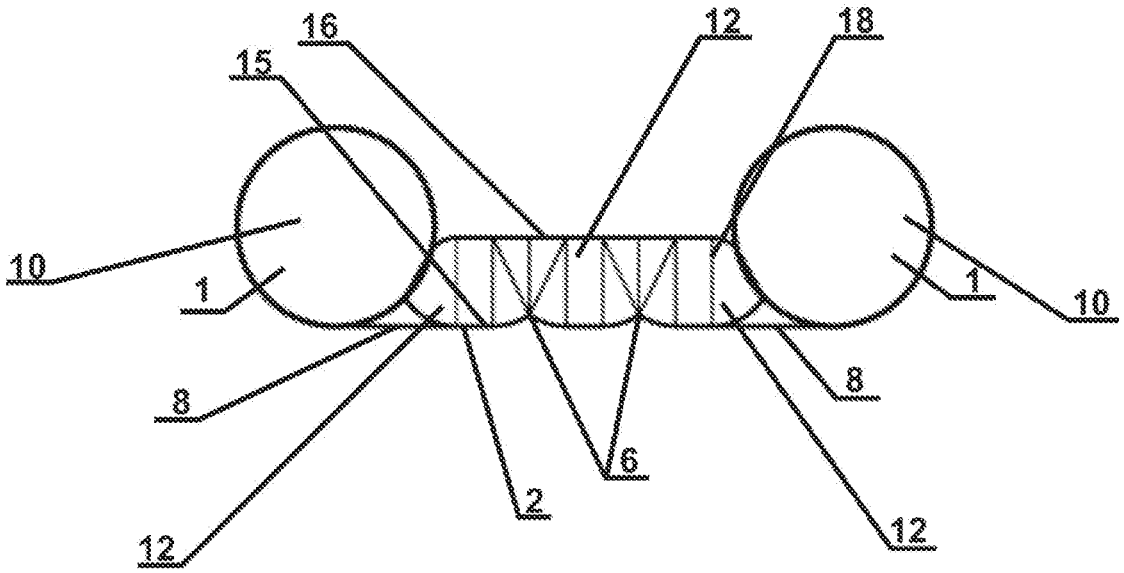
FIG. 16 shows a section of the inflatable motor boat along the line I-I.

The lower surface 15 of the inflatable bottom 2, namely, the surface located in the lower part of the inflatable bottom 2 and contacting the water surface plane when the inflatable motor boat is moving, can comprise longitudinal grooves 7, as shown in FIG. 18, The presence of the longitudinal grooves 7 in the configuration of the lower surface 15 of the inflatable bottom 2, with the seams 18 connecting the parts of the material the inflatable bottom 2 is made from located on the lower surface 15. The presence of the seams 18 in the configuration of the claimed invention ensures the reliability of the connection of the parts of the material the inflatable bottom 2 is made from. As shown in FIG. 15 and FIG. 16, each showing layout of a section along the lines H-H and I-I, respectively, from the stern side, the seams 18 are located vertically inside the inflatable bottom 2. Also, the seams 18 inside the inflatable bottom 2 can be inclined, which is also depicted in FIG. 15 and FIG. 16. Accordingly, the presence of seams 18 on the lower surface 15 of the inflatable bottom 2 will results in the formation of longitudinal grooves 7 in the inflated state.

As shown in FIG. 13 (a longitudinal section along the line F-F, a side view), the inflatable bottom 2 of the boat can be additionally provided with at least two water channels 6. The water channels 6 are longitudinal recesses in the inflatable bottom 2, with the depth significantly exceeded the depth of the longitudinal grooves 7, wherein the presence of the channels on the inflatable bottom is due to the geometry of the seams 18 connecting the parts of the material the inflatable bottom 2 is made from.

In the case of providing an inflatable motor boat with the water channels 6, the water channels 6 can be made as follows. In this embodiment of the claimed invention, the water channels 6 can be made as a continuation of the joint lines between the side walls 13 of the tunnel 3 and the lower surface 15 of the inflatable bottom 2, and also with the upper inclined surface of the tunnel 3, as shown in FIG. 18. Thus, as shown in FIG. 18, the water channels 6 are a continuation of the joint lines between the middle longitudinal segment 12 of the inflatable bottom 2, comprising the tunnel 3, and the segments 12 of the inflatable bottom 2 adjacent to the middle segment 12. As shown in FIG. 14, the tunnel 3, in turn, comprises a portion having a wedge-shaped form in a vertical section. Moreover, the water channels 6 and the tunnel 3 share a common free volume. Structurally, the water channels 6 are located between the joint line of the tunnel 3 and the lower surface 15 of the inflatable bottom 2 and the bow part 11 of the boat, as shown in FIG. 13 and FIG. 18 (bottom view).

Moreover, in a longitudinal section along the line F-F, as shown in FIG. 13, the configuration of the upper wall of the water channel 6 sharing a common free volume with the tunnel 3 has a variable depth and a shape close to a sinusoid.

The providing of the inflatable bottom 2 with water channels 6 ensures the direction of the water flow toward the tunnel 3 when the boat is moving. This effect is due to the fact that when the boat is moving, sticking of the water flow takes place inside the water channel 6, with the following supply thereof into the free volume of the tunnel 3.

Figure 12:
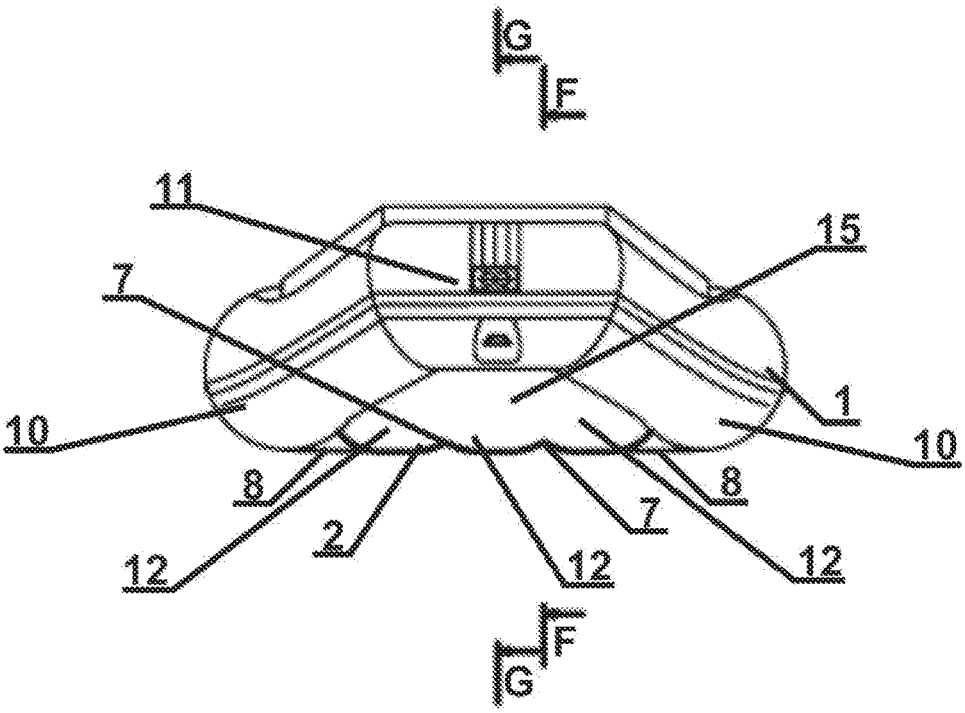
FIG. 12 is a view from the bow part 11 of the inflatable motor boat.
Figure 13:
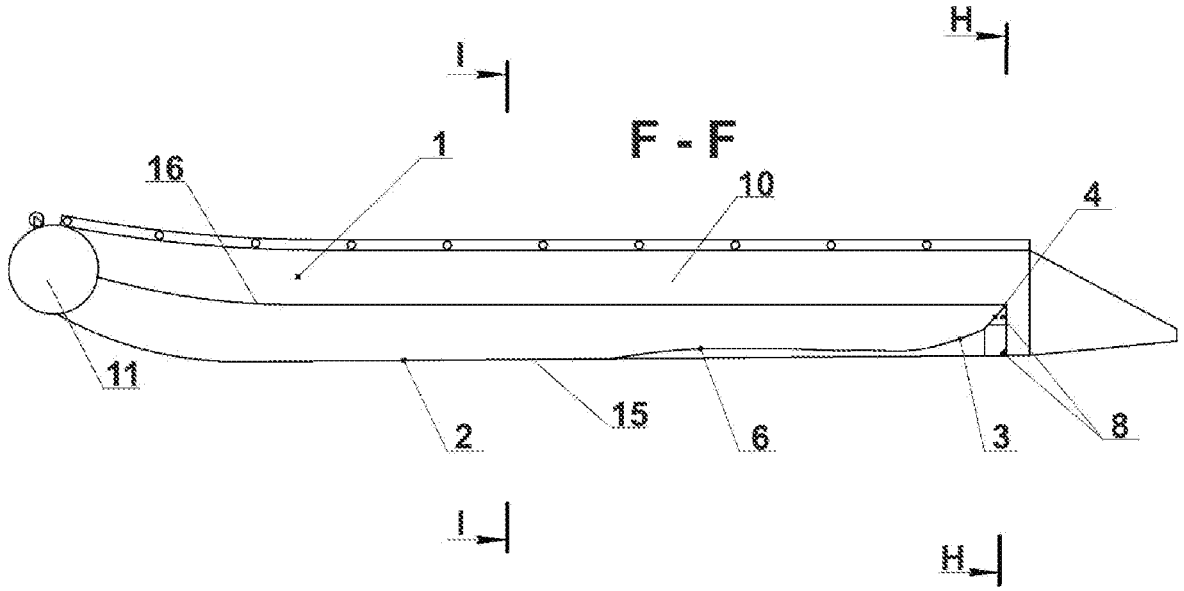
FIG. 13 shows a section along the line F-F of the inflatable motor boat provided with water channels 6.

As shown in FIG. 12, which illustrates a front view of the boat from the how part 11, FIG. 15, which illustrates a section of an inflatable motor boat provided with water channels 6 along the line H-H, and in FIG. 18, in which a bottom view of the inflatable motor boat is shown, the plane of symmetry of the inclined longitudinal tunnel 3 coincides with the vertical plane of symmetry of the hull 1, which is made U-shaped in plan view. The configuring of the hull 1 U-shaped in plan view, in turn, is shown in FIG. 18. In this case, the depth of the inclined tunnel 3 is reduced in the direction from the stern face 4 located in the stern part of the boat to the bow part 11. Such a decrease in the depth of the inclined tunnel 3 is illustrated by cross sections along the lines H-H and I-I shown in FIG. 15 and FIG. 16, respectively. The section along the line I-I (FIG. 16) is located at the larger distance from the stern face 4 toward the bow part 11 of the boat than the section along the line H-H. (FIG. 15), and, naturally, the depth of the inclined tunnel 3 in FIG. 16 is less than the depth of the inclined tunnel 3 in FIG. 15.

The depth of the inclined tunnel 3 reducing in the direction from the stern face 4 to the bow part 11 of the inflatable motor boat and the longitudinal direction of the inclined tunnel 3 provide a smooth water motion vector at an upward angle with the supply of water in the required quantity to the propeller of the outboard engine (not shown in the drawing), with no occurrence of turbulence phenomenon at the location of the propeller (not shown in the drawing). This is achieved by filling the free volume of the tunnel 3 with water when the inflatable motor boat is moving, with minimal water resistance, due to the fact that the vertical plane of symmetry of the tunnel 3 coincides with the vertical plane of symmetry of the hull 1, which, in turn, coincides with the speed vector of the moving inflatable boat. Accordingly, the water flow at the outlet of the tunnel 3 is directed at an upward angle and enters the propeller of the outboard engine (not shown in the drawing) located in such a way that the water flow motion vector at the outlet of the inclined tunnel 3 passes through the axis of rotation of the propeller (not shown in the drawing).

As shown in FIG. 15, the angle of inclination of the tangent to the side wall 13 of the tunnel 3 relative to the surface of the water can be no more than 45° from the vertical line. This allows to configure the side walls 13 in such a way that the width of the tunnel 3 in a cross section is reduced in the direction from the lower surface 15 of the inflatable bottom 2 to the upper inclined surface of the tunnel 3 conjugated with its side walls 13. Such a configuration allows to raise the flow of water inside the tunnel 3 when the claimed inflatable boat is moving and provide the necessary water flow density for trouble-free operation of the outboard engine (not shown in the drawing).

Due to the fact that the angle of inclination of the tangent to the side wall 13 of the tunnel 3 relative to the water surface can be no more than 45° from the vertical line, the inner surface of the tunnel 3 has essentially arc-shaped form, since the shape of the side walls 13 and the upper inclined surface of the tunnel 3 in the inflated state becomes rounded. Accordingly, the cross-sectional shape of the inner surface of the tunnel 3 is arc-shaped, as shown in FIG. 15. Nevertheless, in view of the structural features of the boat, namely the fact that the elements of the bottom 2 are connected to each other by means of seams 18, the joint places between the side walls 13 and the upper inclined surface of the tunnel 3 are presented by small natural recesses. This feature is manifested throughout the length of the longitudinal tunnel 3, including at the conjugation line 14 between the stern face 4 and the longitudinal tunnel 3. The presence of seams 18 in the design of the claimed invention ensures reliable connection of the parts of the material the inflatable bottom 2 is made from.

The conjugation line 14 between the stern face 4 and the longitudinal tunnel 3 comprising the wedge-shaped portion is essentially arc-shaped, as shown in FIG. 15. However, in view of the above-described features of connecting the elements of the inflatable bottom 2 by means of seams 18, the conjugation line 14 between the stern face 4 and the longitudinal tunnel 3 can be made trapezoidal or Π-shaped, which is seen from the stern side in FIG. 15. In this case, the conjugation line 14 between the stern face 4 and the longitudinal tunnel 3 can be made trapezoidal if the angle of inclination of the tangent to the side wall 13 of the tunnel 3 relative to the water surface plane is from 0° to 45° from the vertical line. If the tangent to the side wall 13 of the tunnel 3 is perpendicular to the water surface plane, that is, the angle of inclination of the tangent is 0° from the vertical line, the shape of the conjugation line 14 between the stern face 4 and the longitudinal tunnel 3 can be made Π-shaped.

At the same time, the portion of the conjugation line 14, adjacent to the inclined plane of the longitudinal tunnel 3, can be made curved toward the water surface plane and the plane of the lower surface 15 of the inflatable bottom 2, respectively. This makes it possible to raise the water flow and provide the necessary water flow density for trouble-free operation of the outboard engine (not shown in the drawing), which ensures high efficiency of the inflatable boat use in low water conditions.

The fact, that the inner surface of the longitudinal tunnel 3 has essentially arc-shaped form, provides sticking of the water flow inside the tunnel when the boat is moving, and therefore, the effective water supply from the tunnel 3 to the propeller of the outboard engine (not shown in the drawing).

In this case, the side walls 13 of the inclined tunnel 3 can be made curved toward the free volume, as shown in FIG. 15. This makes it possible to additionally raise the water flow inside the tunnel 3 and provide the necessary water flow density for trouble-free operation of the outboard engine (not shown in the drawing).

In this embodiment of the claimed invention, the stern face 4 of the inflatable bottom 2 can also be made inclined. In this case, the angle of inclination of the stern face 4 relative to the water surface plane and to the lower surface 15 of the inflatable bottom 2 is less than 90°. In this situation, the inclined stern face 4 is connected to the inclined longitudinal tunnel 3. In turn, the inclined longitudinal tunnel 3 is located in the middle segment 12 of the inflatable bottom 2 and connected to the water channels 6, as shown in FIG. 13.

In this embodiment of the claimed invention, a transom (not shown in the drawing) is installed on the upper surface 16 of the inflatable bottom 2, above the stern face 4. In turn, the outboard engine with the propeller (not shown in the drawing) is mounted on the transom (not shown in the drawing). Such a design of the inflatable boat allows the using of outboard engines with a shorter "leg" (381 mm) and positioning the propeller (not shown in the drawing) closer to the water surface plane, above the draft aft of the boat itself. In this case, the total depth of the vehicle immersion into water is reduced, which makes it possible to use it on the shallows, at low water, etc.

The possibility of the use of the outboard engines with the shorter "leg" (381 mm) is provided by the design of the inflatable motor boat comprising at least two water channels 6 connected to the inclined tunnel 3, which in turn is conjugated with the inclined stern face 4, providing a gradual change of the angle of inclination of the water flow relative to the water surface plane when passing from the water channels 6 to the tunnel 3, and then along the inclined stern face 4 when the inflatable motor boat is moving. At first, water enters the water channels 6, after which it continues to move inside the inclined longitudinal tunnel 3 comprising the wedge-shaped portion. Then the water flow changes the angle of inclination at the conjugation line 14 of the tunnel 3 with the stern face 4 of the inflatable bottom 2. Thus, the possibility of the water flow disruption at the inflection points is eliminated.

Such a motion of the water flow inside the water channels 6 and the inclined longitudinal tunnel 3 comprising the wedge-shaped portion, and then along the inclined stern face 4 provides a smooth water motion vector at an upward angle with the supply of water in the required quantity to the propeller of the outboard engine (not shown in the drawing), with no occurrence of turbulence phenomenon at the location of the propeller (not shown in the drawing). Also, such a motion of the water flow inside the water channels 6 and the inclined longitudinal tunnel 3 comprising the wedge-shaped portion, and then along the inclined stern face 4 ensures a smooth moving of the boat at the time of coming onto plane (into gliding), which ensures high-performance boating, including in low water conditions.

Such a configuration allows positioning the propeller of the outboard engine (not shown in the drawing) in such a way that the speed vector of the inflatable motor boat coincides with the outboard engine thrust vector (not shown in the drawing) and the axis of rotation of the propeller (not shown in the drawing), respectively, and is directed to the center of mass of the inflatable motor boat. This results in a smooth moving of the inflatable motor boat and allows to eliminate the effect of the boat oscillating in a vertical plane when in motion, for example, at the time of coming onto plane (into gliding). It follows that this configuration is optimal for the location of the propeller of the outboard engine (not shown in the drawing), which allows to eliminate the risk of damage to the propeller (not shown in the drawing) and improves the efficiency of the boat use in low water conditions.

In the context of one possible embodiment of the claimed invention, the inflatable bottom 2 can be further provided with at least one transom plate 8, as shown in FIGS. 12 to 14. By way of example, the transom plate 8 can have the shape of a triangle, as shown in FIG. 18.

As an example, the inflatable bottom 2 can be further provided with three transom plates 8, as shown in FIG. 18, wherein the edges of the transom plates 8 are located within the outer contour formed by the stern face 4 and the inflatable boards 10 of the hull 1.

Figure 17:
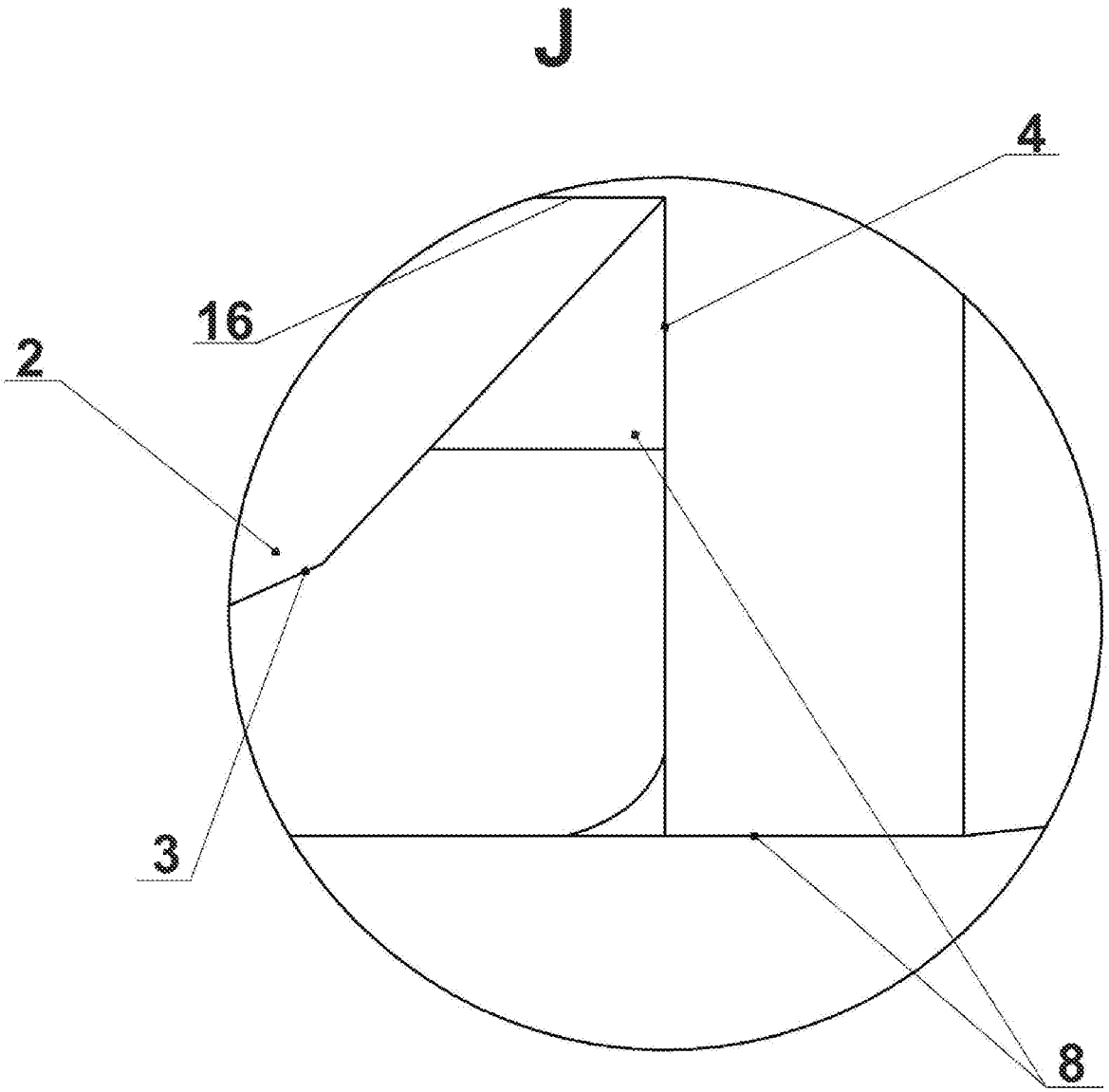
FIG. 17 illustrates a region J showing transom plates 8 and the inclined stern face 4.

Providing the inflatable bottom 2 with at least one transom plate 8, as shown in FIG. 17, allows to avoid drawdown of the stern part of the inflatable boat when the boat is coming onto plane (into gliding) and ensures stable movement of the inflatable motor boat. This aspect is important in the case of use the claimed inflatable motor boat in low water conditions, as it helps to prevent damage to the propeller of the outboard engine (not shown in the drawing).

The inflatable bottom 2 can be made of any known design. As an example, the inflatable bottom 2 can be made flat or can be provided with a keel 17. An embodiment of the inflatable boat equipped with the keel 17 is shown in FIG. 3, which illustrates a side view of the inflatable boat.

The experiments conducted by the applicants showed that the most uniform water motion occurs in cases where the angle of inclination of the tunnel 3 relative to the water surface is not more than 20°.

As an example of a possible implementation of the invention, the angle of inclination of the stern face 4 relative to the water surface plane and to the lower surface 15 of the bottom 2, respectively, can be from 50° to 70°.

It should be kept in mind that increasing the length of the longitudinal tunnel 3 results in a decrease in the course stability of the boat. In general, it is not recommended to make the length of the tunnel 3 more than 50% of the overall length of the boat.

The uniformity of the water motion inside the tunnel 3 also depends on its width, wherein a large width provides greater uniformity of motion. However, it should be kept in mind that configuration of the tunnel 3 with a width exceeding 40% of the overall width of the boat results in a decrease in the lateral stability, therefore, when manufacturing boats up to 6 m in length, it is desirable that the width of the tunnel 3 does not exceed 60 cm.

As shown by comparative tests when operating in the same conditions, boats with the declared geometry of the tunnel 3 can effect a saving in the consumption of fuel up to 3% relative to boats with the geometry of the tunnel 3 outside the claimed ranges.

In the case of providing the inflatable bottom 2 of the claimed inflatable motor boat with the water channels 6 connected to the tunnel 3, the uniformity of the water motion is additionally ensured by the presence of the water channels 6, providing water supply to the tunnel 3, due to the directioning the water flow inside the inclined tunnel 3. This, inter alia, ensures subsequent uniform water motion inside the tunnel 3.

The most efficient water supply to the tunnel 3 in the case of providing the inflatable bottom 2 with the water channels 6 connected to the tunnel 3 is reached if the depth of the water channels 6 is from 5 to 26 cm, the width is from 3 to 20 cm, and the total length of the tunnel 3 and water channels 6 is from 20 to 380 cm. These dimensions are resulted from a number of practical experiments under real-life conditions.

The claimed design of the inflatable boat in any possible embodiment thereof allows the use of the outboard engines with a short "leg" (381 mm.) and positioning the propeller (not shown in the drawing) as nearly as possible to the stern face 4 and water surface plane, i.e. significantly higher than the draft aft of the boat itself. In this case, the total depth of the vehicle immersion into water is reduced, which makes it possible to use it on the shallows, at low water, etc. In addition, the hull 1 and the bottom 2 of the inflatable boat are a kind of protection for the propeller located somewhat above the bottom 2 (or water jet inlet in the case of water jet engine) (not shown in the drawing) from possible mechanical damage caused by stones, logs and other "stock" in the water.

In addition, the positioning of the propeller (not shown in the drawing) as nearly as possible to the stern face 4 reduces the likelihood of water splashes exposure from the stern side when the inflatable motor boat is moving, and also shifts the center of gravity closer to the center of the boat, improving its stability.

The use of the claimed technical solution allows to improve the performance parameters of inflatable motor boats and provides additional protection for outboard engines mounted thereon from possible mechanical damage.

In the materials of the present application, the preferred disclosure was presented for the implementation of the claimed technical solution, which should not be used as limiting other, particular embodiments, which are not beyond the requested scope of legal protection and will be obvious to those skilled in the relevant field of art.

We claim:

1. An inflatable motor boat comprising:

a U-shaped hull in plan view, which is formed by open outline of inflatable boards and bow part, an inflatable bottom attached to the hull, which bottom is divided into at least three longitudinal segments, wherein a longitudinal tunnel is made in the middle segment of the bottom, while an inner surface of the tunnel further comprises an arc-shaped recess, wherein a width of the longitudinal tunnel is reduced in a rearward direction, wherein the tunnel comprises a portion having a wedge-shaped form in a vertical section with an angle of inclination relative to a water surface plane from 5° to 45°, and wherein the tunnel comprises an additional portion with an angle of inclination from 0° to 20°, wherein the length of the additional portion is less than the length of the wedge-shaped portion.

2. The inflatable motor boat according to claim 1, wherein the width of the tunnel at the line of the conjugation with the stern face of the inflatable bottom is from 20 to 60 cm.

3. The inflatable motor boat according to claim 1, wherein the tunnel length is from 5 to 50% of the overall length of the boat.

4. The inflatable motor boat according to claim 1, wherein the angle of inclination of the tangent to the side wall of the tunnel is not more than 45° from the vertical line.

5. An inflatable motor boat comprising:

a U-shaped hull in plan view, which is formed by open outline of inflatable boards and bow part, an inflatable bottom attached to the hull, which bottom is divided into at least three longitudinal segments, wherein a longitudinal tunnel is made in the middle segment of the bottom, which tunnel comprises a portion having a wedge-shaped form in a vertical section, and wherein a stern face of the bottom, conjugated with the tunnel, is upwardly inclined toward a rear direction and forms an angle of less than 90° relative to a water surface plane.

6. The inflatable motor boat according to claim 5, wherein lower corners of the stern face are rounded.

7. The inflatable motor boat according to claim 5, wherein the depth of the tunnel at the line of the conjugation with the stern face of the inflatable bottom is from 2 to 25 CM.

8. The inflatable motor boat according to claim 5, wherein the width of the tunnel at the line of the conjugation with the stern face of the inflatable bottom is from 20 to 60 cm.

9. The inflatable motor boat according to claim 5, wherein the angle of inclination of the wedge-shaped portion of the tunnel relative to the water surface plane is from 5° to 45°.

10. An inflatable motor boat comprising:

a U-shaped hull in plan view, which is formed by open outline of inflatable boards and bow part, an inflatable bottom attached to the hull, which bottom is divided into at least three longitudinal segments, wherein a longitudinal tunnel is made in the middle segment of the bottom, and wherein at least two water channels of variable depth are made in the inflatable bottom as a continuation of the longitudinal tunnel, wherein an upper surface of the tunnel has a sinusoidal shape in a longitudinal section.

11. The inflatable motor boat according to claim 10, wherein the water channels are made as a continuation of joint lines formed between adjacent segments of the inflatable bottom.

12. The inflatable motor boat according to claim 10, wherein the total length of the tunnel and the water channel connected thereto is from 20 to 380 cm.

13. The inflatable motor boat according to claim 10, wherein a stern face of the bottom, conjugated with a longitudinal tunnel, is made inclined, with an angle of less than 90° relative to a water surface plane.

14. The inflatable motor boat according to claim 10, wherein the longitudinal tunnel comprises a portion having a wedge-shaped form in a vertical section.

15. The inflatable motor boat according to claim 14, wherein the angle of inclination of the tunnel relative to the water surface plane is from 5° to 45°.

16. The inflatable motor boat according to claim 10, wherein the depth of the tunnel at the line of the conjugation with a stern face of the inflatable bottom is from 2 to 25 cm.

17. The inflatable motor boat according to claim 10, wherein the width of the tunnel at the line of the conjugation with a stern face of the inflatable bottom is from 20 to 60 cm.

* * * * *